US009874893B2

(12) United States Patent
Ciubotaru

(10) Patent No.: US 9,874,893 B2
(45) Date of Patent: Jan. 23, 2018

(54) SELF-BIASED MULTIPLE CASCODE CURRENT MIRROR CIRCUIT

(71) Applicant: Analog Devices, Inc., Norwood, MA (US)

(72) Inventor: Alexandru A. Ciubotaru, Somerset, NJ (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 14/722,863

(22) Filed: May 27, 2015

(65) Prior Publication Data

US 2016/0349785 A1 Dec. 1, 2016

(51) Int. Cl.

| | |
|---|---|
| ***G05F 3/26*** | (2006.01) |
| ***G05F 1/46*** | (2006.01) |
| ***G05F 1/10*** | (2006.01) |

(52) U.S. Cl.

CPC ..... *G05F 3/262* (2013.01); *G05F 1/10* (2013.01); *G05F 1/46* (2013.01); *G05F 3/26* (2013.01)

(58) Field of Classification Search

CPC ..... G05F 1/10; G05F 3/262
USPC ..... 323/315
See application file for complete search history.

(56) References Cited

U.S. PATENT DOCUMENTS 5,359,296 A 10/1994 Brooks et al.
5,801,578 A * 9/1998 Bereza ..... H03L 7/0896 327/157
6,515,547 B2 2/2003 Sowlati
6,888,396 B2 5/2005 Hajimiri et al.
(Continued)

FOREIGN PATENT DOCUMENTS

EP 1806846 A1 7/2007

OTHER PUBLICATIONS

Agah, Amir, et al., "Multi-Drive Stacked-FET Power Amplifiers at 90 GHz in 45 nm SOI CMOS", IEEE Journal of Solid-State Circuits, 49(5), (2014), 1148-1157.
(Continued)

*Primary Examiner* — Jue Zhang
*Assistant Examiner* — Trinh Q Dang
(74) *Attorney, Agent, or Firm* — Schwegman Lundberg & Woessner, P.A.

(57) ABSTRACT

A self-biased cascode current mirror/scaler circuit can include a bias FET biased with an input current to generate a gate-source voltage, which can be divided by a bias circuit into a first voltage component (e.g., at a threshold voltage) and a second voltage component (at a FET drain-source saturation voltage or edge of saturation voltage). An input FET of the current mirror/scaler circuit can receive approximately the input current or a function thereof. A gate of the input FET can be biased at the first voltage component in sum with a FET drain-source saturation voltage or edge of saturation voltage of the input FET. A gate of the output FET can be connected to the gate of the input FET. A gate of a cascode FET in series with the output FET can be biased at the first voltage component in sum with the second voltage component in sum with the FET drain-source saturation voltage or edge of saturation voltage of the input FET. Multiple cascode FETs, multiple output stages, high frequency bypass capacitors, and lowpass filters are also described.

26 Claims, 30 Drawing Sheets

(56) References Cited

U.S. PATENT DOCUMENTS

| | | | | |
|---|---|---|---|---|
| 7,279,981 | B1 * | 10/2007 | Moscaluk | H03F 1/342 330/288 |
| 2004/0246052 | A1 * | 12/2004 | Deval | H03F 3/4521 330/253 |
| 2010/0301944 | A1 * | 12/2010 | Yamamoto | H01L 27/0605 330/277 |
| 2011/0304387 | A1 * | 12/2011 | Hirashiki | G05F 3/262 327/542 |
| 2015/0061631 | A1 * | 3/2015 | Utsuno | G05F 1/563 323/284 |

OTHER PUBLICATIONS

Chakrabarti, Anandaroop, et al., "High Power, High Efficiency nmWave Class-E-like Power Amplifiers in 45nm SOI CMOS", IEEE Custom Integrated Circuits Conference, (CICC 2012), (2012), 1-4.

Crawley, P. J., et al., "High-Swing MOS Current Mirror With Arbitrarily High Output Resistance", Electronics Letters, 28(4), (1992), 361-363.

Datta, Kunal, et al., "A Triple-Stacked Class-E mm-Wave SiGe HBT Power Amplifier", IEEE MTT-S International Microwave Symposium Digest (IMS), (2013), 1-3.

Kao, Min-Sheng, et al., "20-Gb/s CMOS EA/MZ Modulator Driver With Intrinsic Parasitic Feedback Network", IEEE Transactions on Very Large Scale Integration (VLSI) Systems, vol. 22, No. 3, (2014), 475-483.

Liu, Ying-Chauan, et al., "A CMOS Current Mirror with Enhanced Input Dynamic Range", 3rd International Conference on Innovative Computing Information and Control, ICICIC '08, (2008), 571-574.

Steyaert, M., "An Improved CMOS Current Mirror Using a Bulk-Effect Independent Cascode Biasing Structure", European Conference on Circuit Theory and Design, (1989), 656-660.

Yeh, Han-Chih, et al., "Analysis and Design of Millimeter-Wave Low-Power CMOS LNA With Transformer-Multicascode Technology", IEEE Transactions of Microwave Theory and Techniques, 59(12), (2011), 3442-3454.

Yeh, Han-Chih, et al., "Analysis and Design of Millimeter-Wave Low-Voltage CMOS Cascode LNA With Magnetic Coupled Technique", IEE Transactions on Microwave Theory and Techniques, 60(12), (2012), 4066-4079.

* cited by examiner

SELF-BIASED MULTIPLE CASCODE CURRENT MIRROR CIRCUIT

BACKGROUND

Current mirrors can be used in analog circuits for providing current bias or signals to a variety of circuits. The output impedance of the current mirror can affect the accuracy of the current provided by the current mirror. High output impedance in current mirrors is desired for accurate replication of currents. Cascode transistors can be used to obtain high output impedance. A current mirror may also be characterized as having an output voltage swing. High voltage swing in current mirrors can be desired for accurate operation, such as with low power supply voltages, and for increased voltage signal amplitudes, which can improve the accuracy of analog circuitry utilizing the current mirrors.

Current mirrors are building blocks used in integrated circuits. In CMOS technologies, current mirrors operate on the principle that if the gate-source voltages of two identical transistors are equal, then their drain currents are equal. A current mirror's output impedance can be represented by the slope of the output current when graphed against the output voltage—the smaller the slope, the higher the output impedance. A high output impedance can be desirable for a current mirror because parameters of the circuits with which the current mirror is used can be detrimentally affected by a low output impedance (e.g., the common-mode rejection ratio of a differential transistor pair can be worse with low output impedance of a current mirror sourcing or sinking current to the differential pair). A current mirror's compliance voltage range parameter provides a measure of the output voltage range over which the current mirror can maintain a constant output current.

One approach to achieving high output impedance for a current mirror is to use one or more cascode transistors in series with an output transistor of the current mirror. While the cascode transistors themselves do not consume current, additional circuits that consume current can be needed provide bias voltages for their gates. Moreover, if cascode gate bias voltages are not well-controlled for ensuring transistor operation at the lower end or edge of the saturation region, a substantial reduction in the compliance voltage range can occur.

SUMMARY/OVERVIEW

The present inventor has recognized, among other things, that one approach to limit current consumption for the cascode bias circuits in current mirrors is to use a self-biased cascode device, such as in which the input current itself can be used to bias one or more cascode devices. A challenge in providing one or more self-biased cascodes is to achieve a large compliance output voltage range and enough voltage margin, such as to accommodate process, temperature, and input-current variations.

This document describes, among other things, a device that can include a self-biased cascode current mirror/scaler circuit ("mirroring" can include providing an output current that is a scaled version of the input current, rather than an output current that is identical in magnitude to the input current). The self-biased cascode current mirror/scaler circuit can include a bias field-effect transistor (FET). The bias FET can have a drain electrically coupled to a gate, and having a source. The bias FET can be biased using a first input current to generate a gate-source bias voltage, Vgs, between the gate and the source of the bias FET.

A first bias circuit can be electrically coupled to the bias FET, such as to receive the Vgs provided by the bias FET. The first bias circuit can be arranged to divide Vgs into a first voltage component (which can be specified at a FET threshold voltage) and a second voltage component (which can be specified at a FET drain-source saturation voltage ΔVds). An input FET of the current mirror/scaler can have a drain electrically coupled to receive a drain current (which can optionally be approximately equal to a drain current of the bias FET, or a function thereof). A first output stage can include a first output FET, having a gate electrically coupled to apply the voltage at the gate of the input FET. A drain of the output FET can provide a first output current that is mirrored or scaled as a specified function of the first input current. A first cascode FET can be in series with the first output FET to pass the first output current between a drain and a source of the first cascode FET. A gate of the first cascode FET can be biased by the first bias circuit at a voltage that is equal to the second voltage component in sum with the first voltage component in sum with a FET drain-source saturation voltage ΔVds (e.g., of the input FET of the current mirror/scaler).

DETAILED DESCRIPTION

Figure 1:
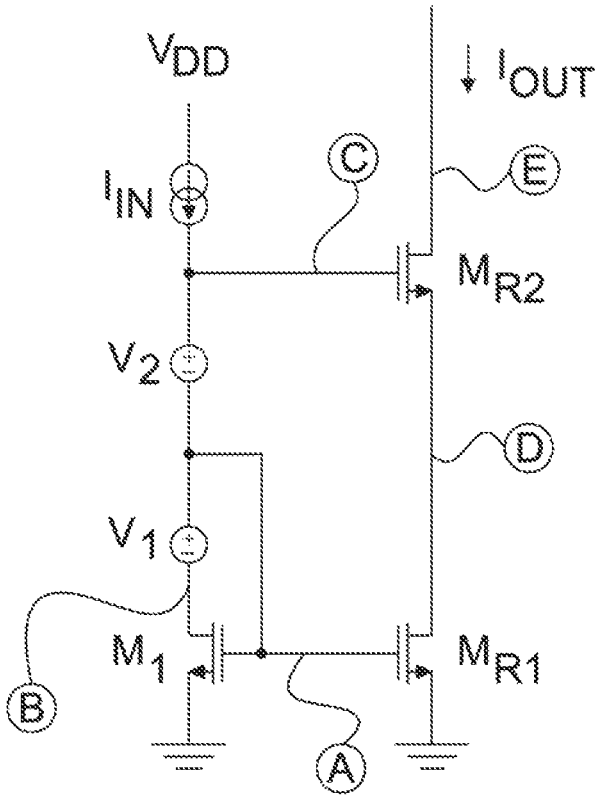
FIG. 1 shows an example of a self-biased cascode current mirror.

FIG. 1 shows an example of a self-biased CMOS cascode current mirror. An input branch can include DC sources $V_1$ and $V_2$, and transistor $M_1$. An output branch can include replica transistors $M_{R1}$, $M_{R2}$. Voltages $V_1$ and $V_2$ can be chosen such that all transistors operate in the saturation region. If all the transistors are assumed identical, saturation is met if the following conditions apply:

$$V_1 \geq V_T, \tag{1}$$

$$V_2 \geq V_{DSAT}, \tag{2}$$

where $V_T$ is the threshold voltage of the transistors and $V_{DSAT}$ is their drain-source saturation voltage. For increased or maximum compliance output voltage range of the current mirror (e.g., lowest possible voltage equal to $2V_{DSAT,EOS}$ (at edge of saturation EOS) on output node E) and good current matching between input and output, voltages $V_1$ and $V_2$ should ideally assume their limit values, e.g., $V_1=V_T$ and $V_2=V_{DSAT,EOS}$, which can be difficult to achieve. It can also be very difficult to ensure conditions (1) and (2) for a wide range of input currents. Process and temperature variations should also be accommodated, which can introduce additional restrictions.

Figure 2:
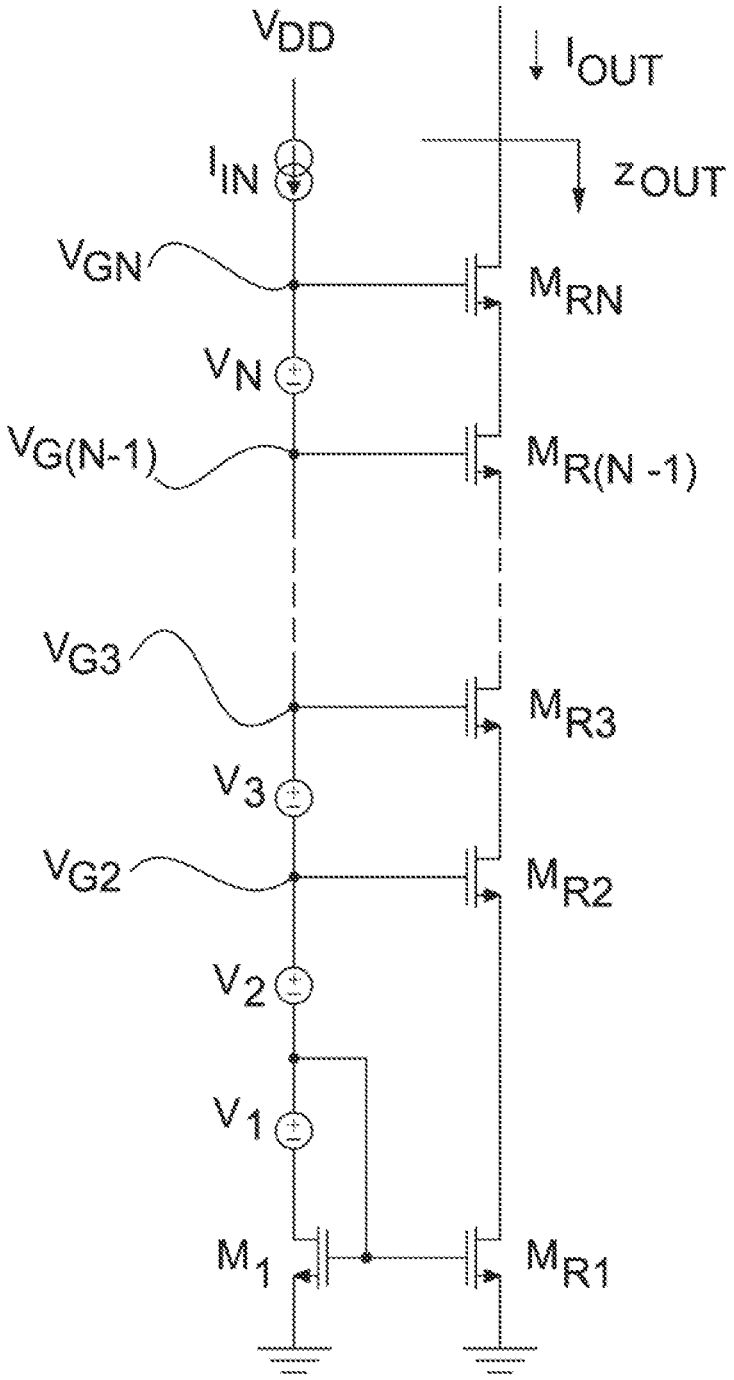
FIG. 2 shows an example of a self-biased multiple-cascode current mirror circuit.

FIG. 2 shows an illustrative example of a self-biased multiple-cascode current mirror circuit. In the generalized example of FIG. 2, an N≥1 number of identical output cascode devices $M_{Rk}$, k=1, . . . , N, can be used in the output branch, such as for an improved output impedance $z_{OUT}$. The gates of the output transistors $M_{Rk}$ can be connected to the intermediate nodes of a chain of ideally-equal voltage sources $V_2=V_3=\ldots=V_N \geq V_{DSAT}$; voltage $V_1$ can be chosen such that is satisfies condition (1). In this way, all transistors in FIG. 2 can operate in saturation, and a substantially higher output impedance $z_{OUT}$ can obtained for larger N. Again, using certain circuits, it can be very difficult to ensure proper values for the voltages $V_1, V_2, \ldots, V_N$, such that all transistors operate at the lower limit of the saturation region $V_{DSAT,EOS}$ for maximum compliance output voltage range. The minimum achievable output voltage for the circuit in FIG. 2 is $N \cdot V_{DSAT}$.

Figure 3:
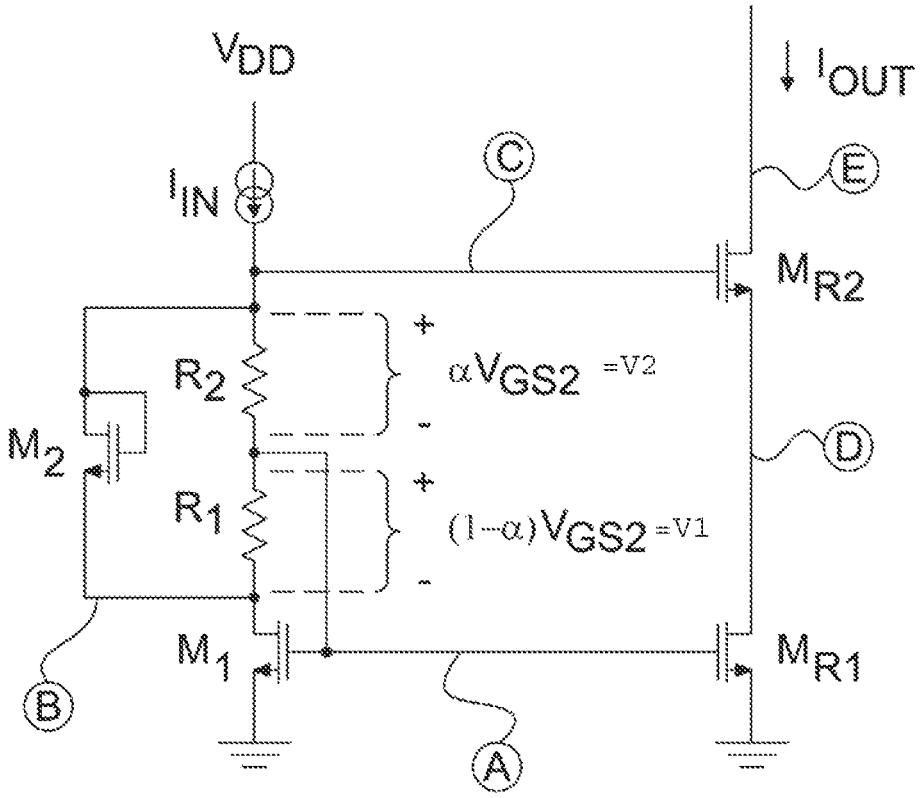
FIG. 3 shows an example of a self-biased cascode current mirror circuit.

FIG. 3 shows an example of a self-biased cascode current mirror circuit. In an example, the circuit can include an input branch that can include transistors $M_1$, $M_2$ and resistors $R_1$, $R_2$, and an output branch that can include transistors $M_{R1}$, $M_{R2}$. The transistors can be assumed to be identical (e.g., have same transconductance parameter K', width W, length L, and threshold voltage $V_T$), and the body effect (generally responsible for an undesirable increase in threshold voltage when the source node is at higher potential than the substrate node) can be assumed negligible. Resistors $R_1$ and $R_2$ can be assumed large enough such that input current $I_{IN}$ flows mainly through transistor $M_2$ and only a small fraction of it through the resistors, such that $$\frac{V_{GS2}}{R_1 + R_2} << I_{IN},$$

where $V_{GS2}=V_C-V_B$ (difference between voltages on nodes C and B). In an example, $R_1$ and $R_2$ can be used to generate the voltages $V_1$ and $V_2$ in the diagram of FIG. 1 as fractions of the gate-source voltage $V_{GS2}$, such that all transistors operate in saturation. In an example in which current $I_{IN}$ serves as drain current for both $M_1$ and $M_2$, assuming that proportionality factor $$\alpha = \frac{R_2}{R_1 + R_2} < 1$$

is chosen large enough such that $M_1$ operates in saturation ($M_2$ operates in saturation because of the diode connection), the following equation applies:

$$V_{GS1} = V_{GS2} = V_T + \sqrt{\frac{2I_{IN}}{\beta}}, \tag{3}$$

$$\text{where } \beta = K'\frac{W}{L}.$$

The condition for transistor $M_1$ to operate in saturation is $V_{DS1} \geq V_{GS1}-V_T$, which, using the node notations in FIG. 3, is equivalent to $V_B \geq V_{GS1}-V_T$. Using Eqn. (3), this can be re-written as:

$$V_B \geq \sqrt{\frac{2I_{IN}}{\beta}}. \tag{4}$$

At the same time, however, $V_B=V_A-(1-\alpha)V_{GS2}$, and $V_A=V_{GS1}=V_{GS2}$, which yields:

$$V_B=V_{GS2}-(1-\alpha)V_{GS2}=\alpha V_{GS2}. \tag{5}$$

Using (3) and (5), the condition (4) for $M_1$ to operate in saturation is re-written as:

$$\alpha V_{GS2} \geq \sqrt{\frac{2I_{IN}}{\beta}}; \tag{6}$$

$$\alpha\left(V_T+\sqrt{\frac{2I_{IN}}{\beta}}\right) \geq \sqrt{\frac{2I_{IN}}{\beta}}; \tag{7}$$

$$\alpha = \frac{R_2}{R_1+R_2} \geq \alpha_{min} = \frac{\sqrt{\frac{2I_{IN}}{\beta}}}{V_T+\sqrt{\frac{2I_{IN}}{\beta}}}; \tag{8}$$

$$\frac{R_2}{R_1} \geq \frac{1}{V_T}\sqrt{\frac{2I_{IN}}{\beta}}. \tag{9}$$

With all transistors in FIG. 3 assumed identical and conducting the same current, we have $V_{GSR1}=V_{GSR2}=V_{GS1}=V_{GS2}=V_A$, and the drain-source voltage of $M_{R1}$ (assuming $V_E$ is large enough so that $M_{R2}$ is in saturation) can be calculated as:

$$V_{DSR1}=V_D=V_A+\alpha V_{GS2}-V_{GSR2}=\alpha V_{GS2}=V_B=V_{DS1} \tag{10}$$

Because $V_{DSR1}=V_{DS1}$ (from (10)), it follows that meeting condition (9) ensures operation in the saturation region for both $M_1$ and $M_{R1}$.

If $\alpha=\alpha_{min}$ (e.g., as defined in (8)), all transistors can operate at the lower limit of the saturation region ("edge of saturation" or "EOS"). The voltage developed across $R_2$ is a fraction (a) of a gate-source voltage ($V_{GS2}$), which is not a strong function of $I_{IN}$, allowing the circuit to tolerate a much wider input current range than certain other approaches. Although condition (9) can be met for a relatively wide input current range, process and temperature variations (which affect $V_T$ and $\beta$) will introduce limitations, and $$\frac{R_2}{R_1}$$

can be chosen sufficiently large in order for (9) to be met under all conditions.

Figure 4:
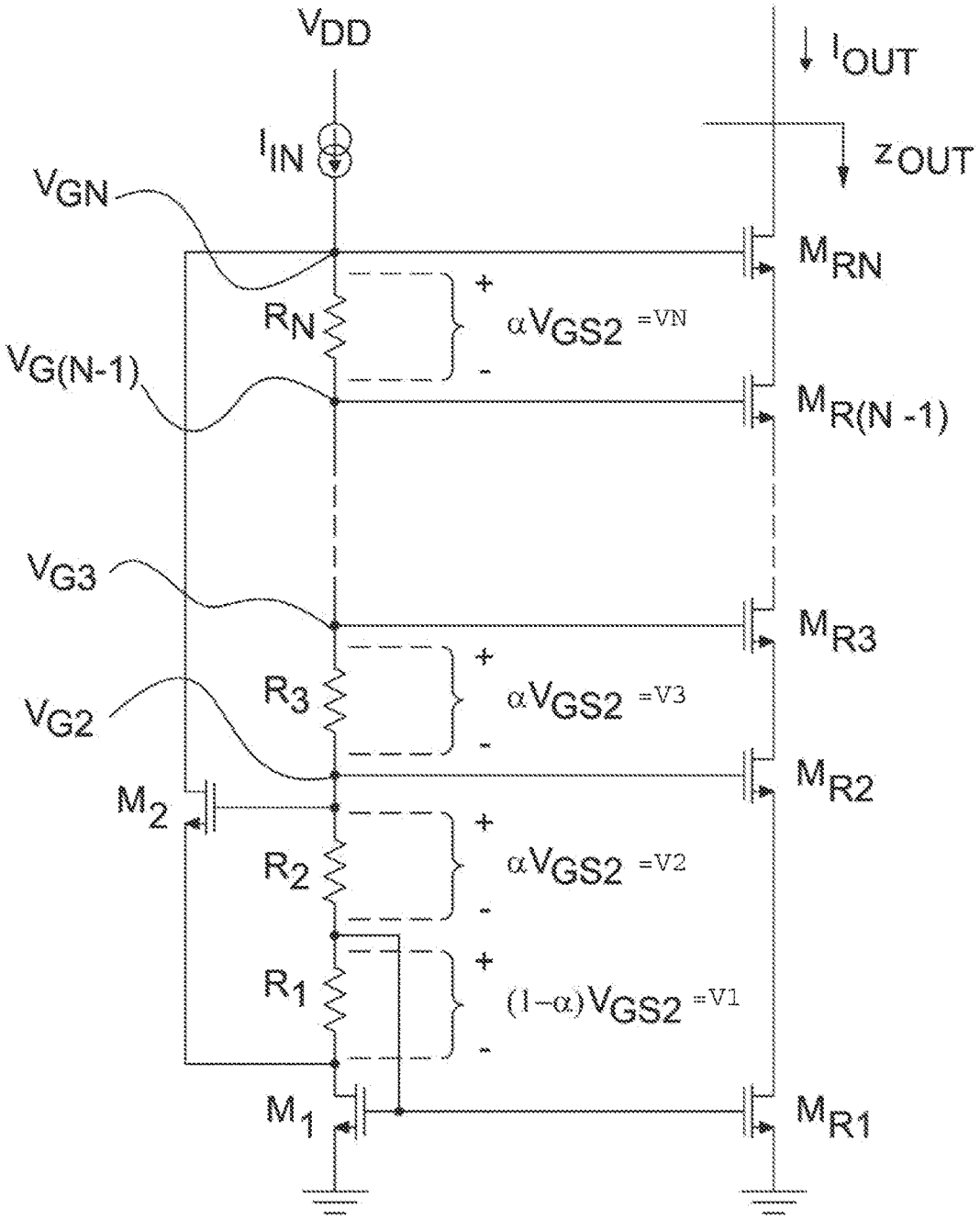
FIG. 4 shows an example of a self-biased multiple-cascode current mirror circuit.

FIG. 4 shows another example, which is a generalization of the self-biased cascode concept of FIG. 3, using an N≥2 number of identical output cascode devices. In FIG. 4, as in FIG. 3, the input current $I_{IN}$ can be mainly accommodated by transistor $M_2$ due to the fact that $R_1$ and $R_2$ can be assumed large enough such that $$\frac{V_{GS2}}{R_1+R_2} << I_{IN}.$$

In addition to the circuit of FIG. 3, the input branch can include additional equal resistors $R_3, \ldots, R_N$ (and equal to $R_2$) such as for biasing the gates of additional identical transistors $M_{R3}, \ldots, M_{RN}$, respectively. Because the drain of $M_2$ can be connected in such a way that only the current flowing through $R_2$ flows through $R_3, \ldots, R_N$, the voltages developed across $R_2, R_3, \ldots, R_N$ are each equal to $\alpha V_{GS2}$. In this way, the circuit can be regarded as conceptually similar to the circuit of FIG. 2, and condition (9) (with the same observations as for FIG. 3) can be met for all transistors to operate in saturation.

Figure 5:
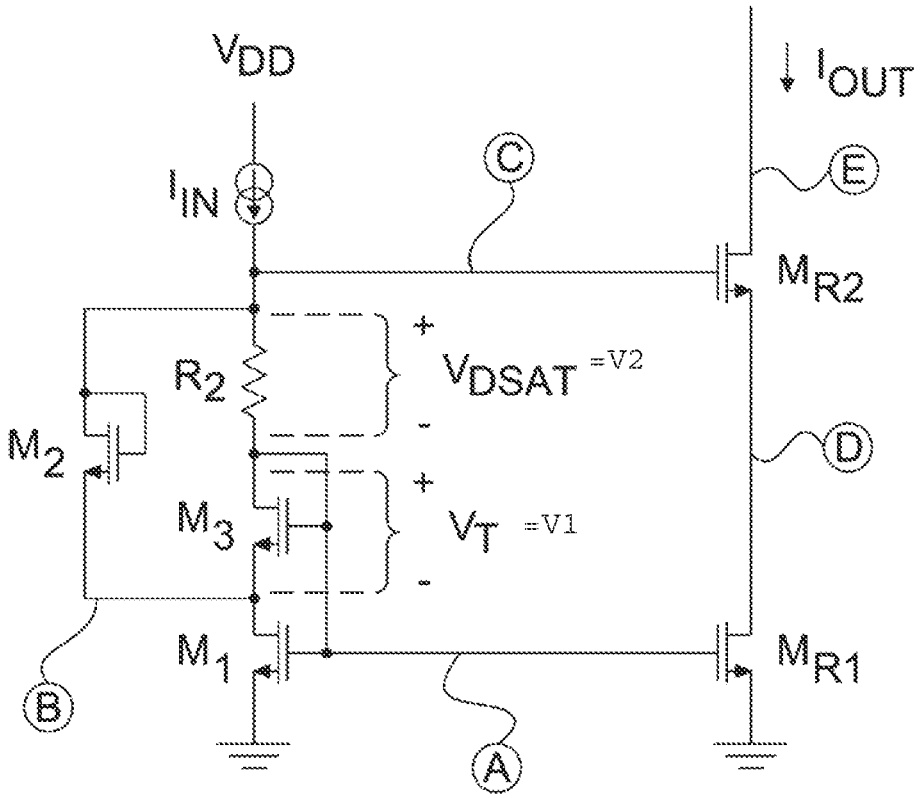
FIG. 5 shows an example of a self-biased cascode current mirror circuit with a bias circuit including a transistor configured to operate at a threshold voltage.

FIG. 5 shows another example that can provide a robust self-biased cascode current mirror. With all transistors assumed identical, resistor $R_2$ can be chosen very large such that practically the entire input current flows only through transistor $$M_2\left(\frac{V_{GS2}-V_T}{R_2} << I_{IN}\right).$$

At the same time, ignoring subthreshold conduction, body effect, velocity saturation, and other second-order behavior, because of the very small drain current of $M_3$, it follows that $V_{GS3} \simeq V_T$. As a consequence, because $M_1$ and $M_2$ conduct practically the same drain current, the voltage across $R_2$ is $V_{GS2}-V_{GS3} \sim V_{GS1} \sim V_T = V_{DSAT}$. In this way, the circuit in FIG. 5 can be regarded as conceptually similar to the circuit in FIG. 1, with $V_1 \sim V_T$, and $V_2 \simeq V_{DSAT}$, which are the ideal conditions for all the transistors to operate at the limit (edge) of the saturation region. In this example, the requirements for operation on saturation can be met regardless of process parameters ($V_T$ or $\beta$). In this way, the circuit can operate with all the transistors at the edge of the saturation region regardless of current $I_{IN}$. Practically, limitations occur at the low end of the current range where maintaining $$\frac{V_{GS2}-V_T}{R_2} << I_{IN}$$

can be problematic, and at the higher end of the range where velocity saturation and possible headroom issues can tend to come into play.

Figure 6:
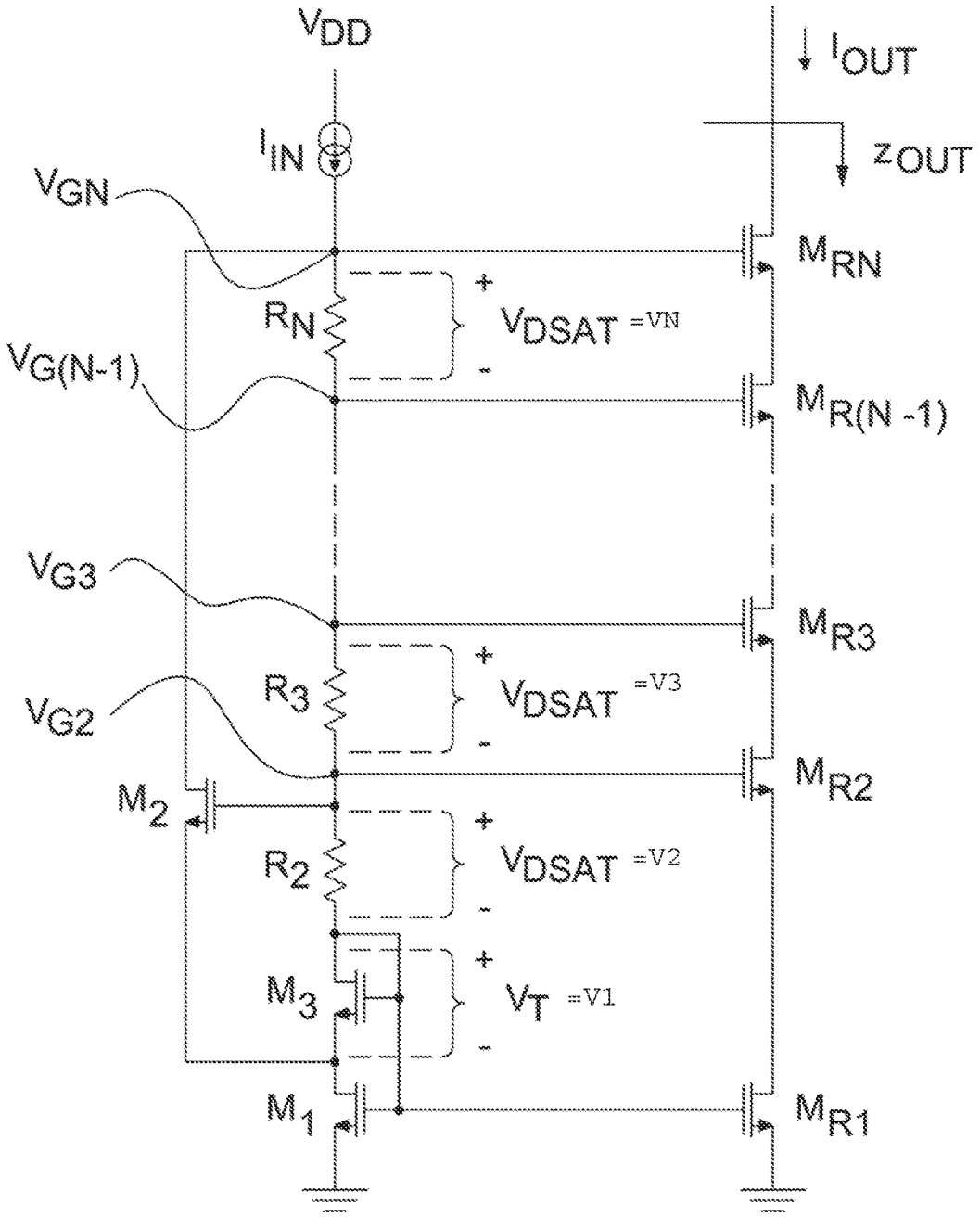
FIG. 6 shows an example of a self-biased multiple-cascode current mirror circuit with a bias circuit including a transistor configured to operate at a threshold voltage.

FIG. 6 shows another example, which can be regarded as a generalization of the self-biased cascode circuit concept of FIG. 5, for an N≥2 number of output cascode devices. With the exception of transistor $M_3$ in lieu of resistor $R_1$, the circuit of FIG. 6 can be topologically identical to the circuit of FIG. 4 and can operate under the same general principles as the circuit in FIG. 2. In certain examples with large N, circuit adjustments can be made to the circuit of FIG. 6 for further robustness. For example, resistor $R_2$ can be adjusted such that $M_3$ operates slightly in subthreshold, and $M_2$ can be slightly undersized relative to $$M_1\left(\frac{W_2}{L_2} \leq \frac{W_1}{L_1}\right)$$

such that the voltage drops across $R_2, R_3, \ldots, R_N$ are slightly larger than $V_{DSAT,EOS}$.

Figure 7:
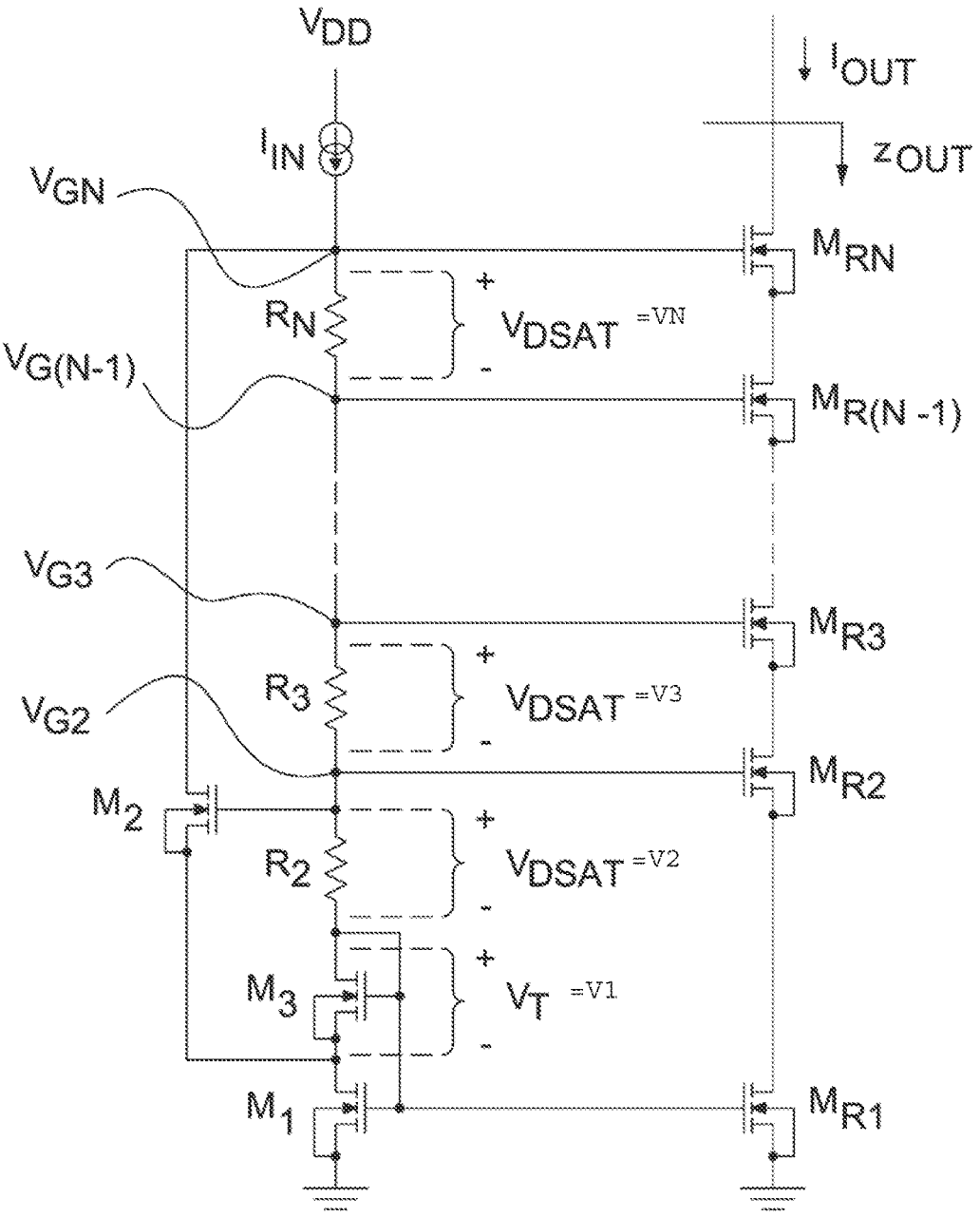
FIG. 7 shows an example of a self-biased multiple-cascode current mirror circuit with a bias circuit including a transistor configured to operate at a threshold voltage and including isolated-well type transistors.

FIG. 7 shows an example that is similar to the circuit of FIG. 6, but in which the transistors can be isolated-well type such as for insensitivity to body effect and better precision.

Figure 8:
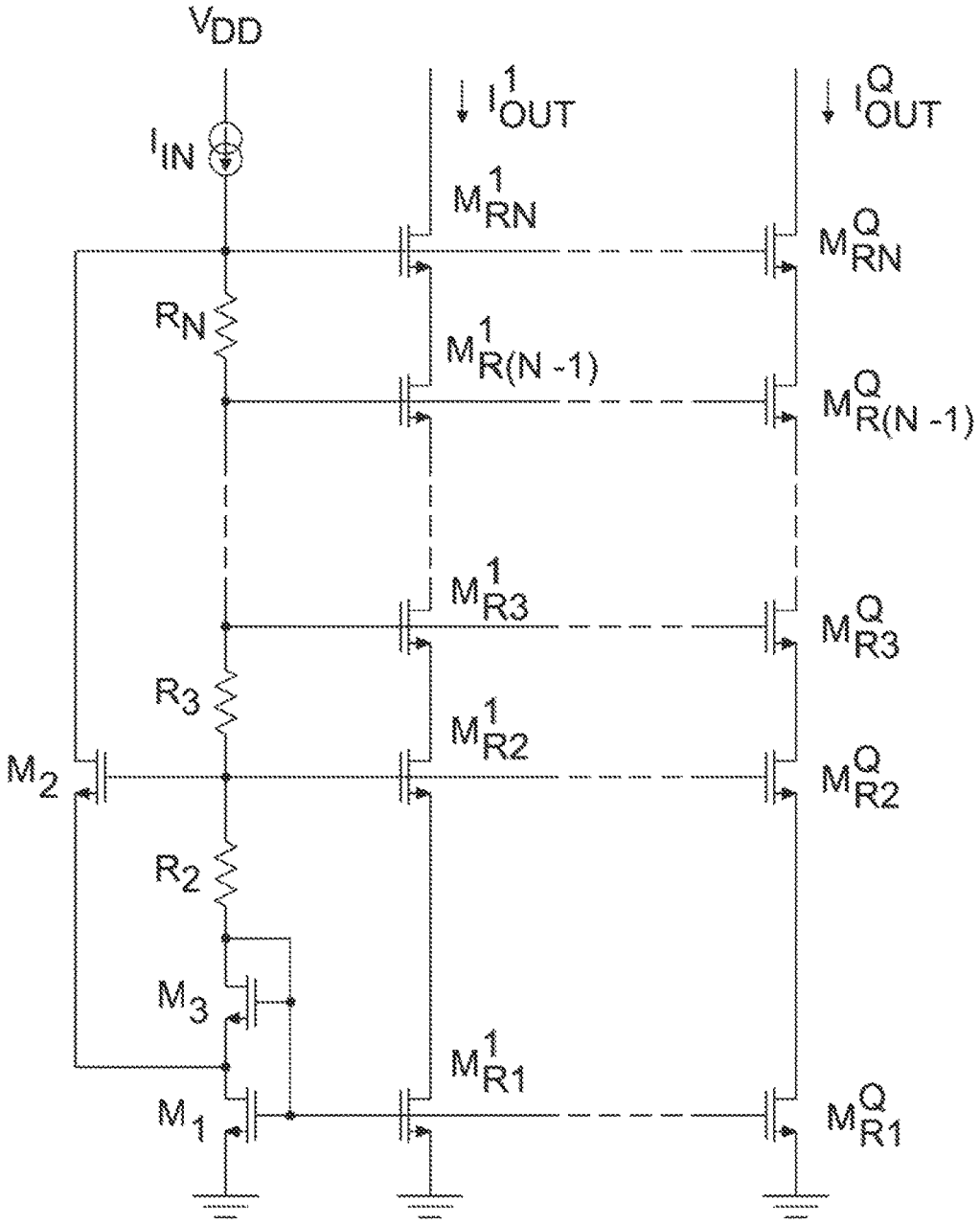
FIG. 8 shows an example of a self-biased multiple-cascode current mirror circuit that can include multiple output stages to provide multiple output currents.
Figure 9:
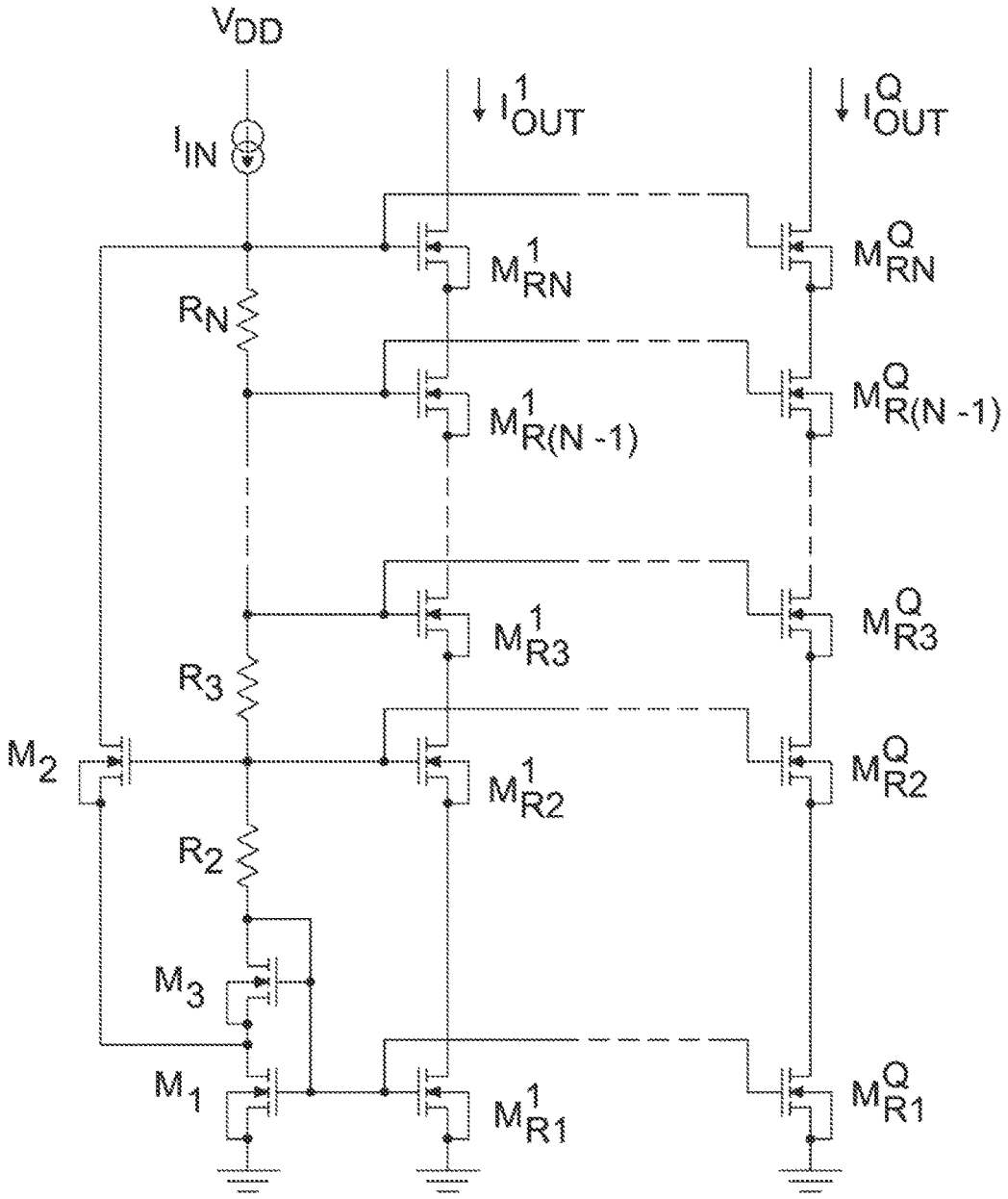
FIG. 9 shows an example of a self-biased multiple-cascode current mirror circuit that can include multiple output stages to provide multiple output currents, and including isolated-well type transistors.

FIGS. 8 and 9 show other examples (using bulk and isolated-well transistors, respectively), which detail the connection of more than one output branch to the same input branch.

Figure 10:
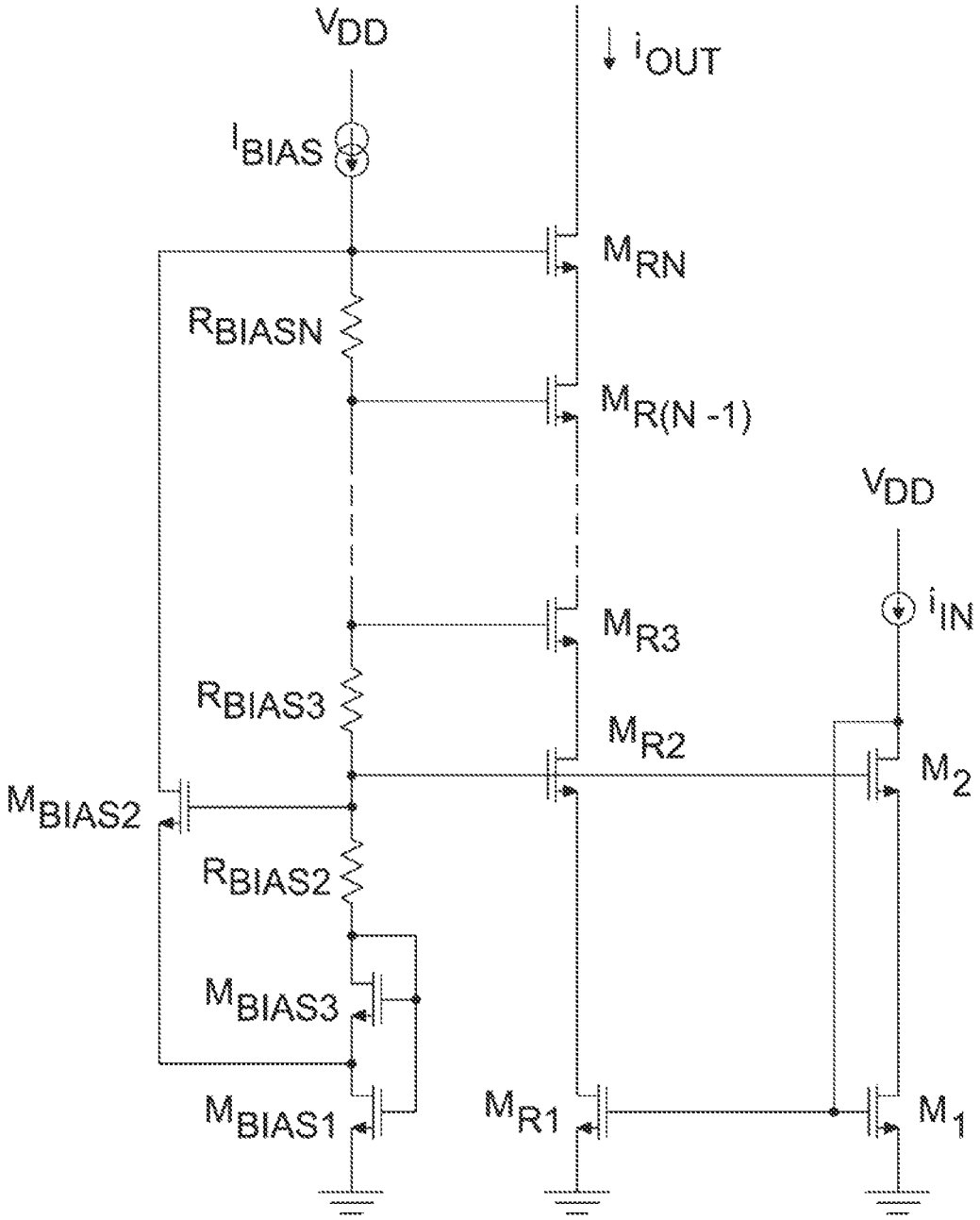
FIG. 10 shows an example of a self-biased current mirror circuit in which the cascode transistor gates can be biased from a different input current than used to bias the output transistor gate.

FIG. 10 shows an example of a current-amplifying multiple-cascode current mirror/scaler. The input branch can include input transistor $M_1$ and input cascode transistor $M_2$. A bias branch of a bias circuit can include bias transistors $M_{BIAS1}$, $M_{BIAS2}$, $M_{BIAS3}$, and resistors $R_{BIAS2}$, $R_{BIAS3}$, . . . , $R_{BIASN}$, such as in an arrangement similar to the input branch in FIG. 6. The output cascode devices $M_{R2}$, $M_{R3}$, . . . , $M_{RN}$ can receive their gate voltages from the bias branch. The current through transistor $M_1$ can be mirrored by the (optionally scaled) transistor $M_{R1}$ and applied to the output such as via the cascode devices, which can be biased close to the edge of the saturation region by the bias branch. The bias branch can be sized such that the cascode devices can operate at the maximum current without exiting the saturation region.

Figure 11:
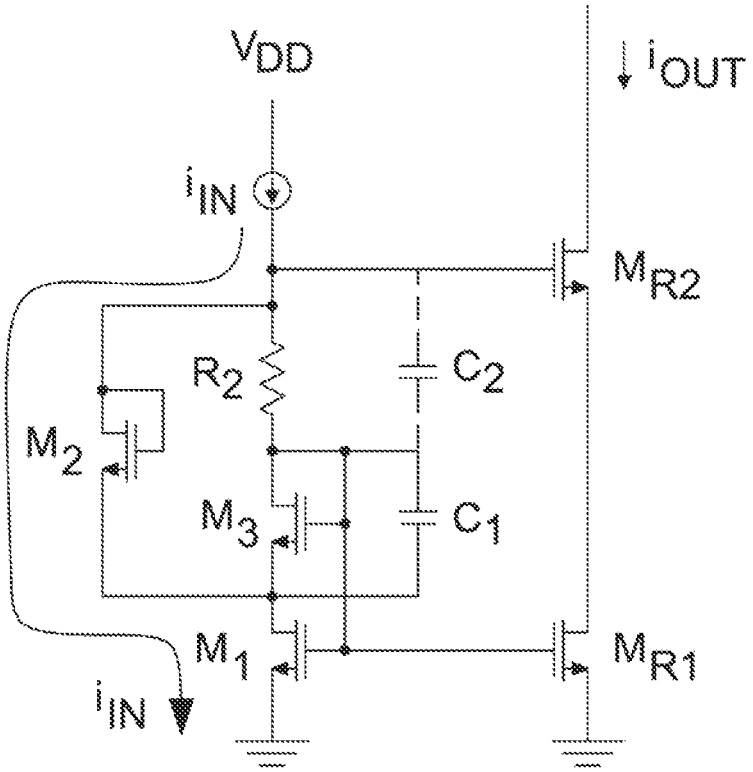
FIG. 11 shows an example of a self-biased current mirror circuit that can include one or more high frequency bypass capacitors.

FIG. 11 shows an example of a self-biased cascode current amplifier. All capacitors (each can be as large as several picoFarads) are optional, and can provide additional low-impedance paths at high frequencies. With capacitor $C_1$ providing a short-circuit at the frequencies of interest, transistor $M_1$ can be diode-connected and can accommodate the signal component of $i_{IN}$ via the indicated path. At high frequencies, without $C_2$ in the circuit, the small input impedance of the amplifier can be provided by the equivalent diode-connected transistors $M_1$ and $M_2$; with $C_2$ in the circuit and shorting $M_2$ at high frequencies, the input impedance reduces to the equivalent resistance of diode-connected $M_1$ only. As in a regular current mirror, current amplification can be achieved by scaling $M_{R1}$ (and implicitly $M_{R2}$) relative to $M_1$ and $M_2$.

Figure 12:
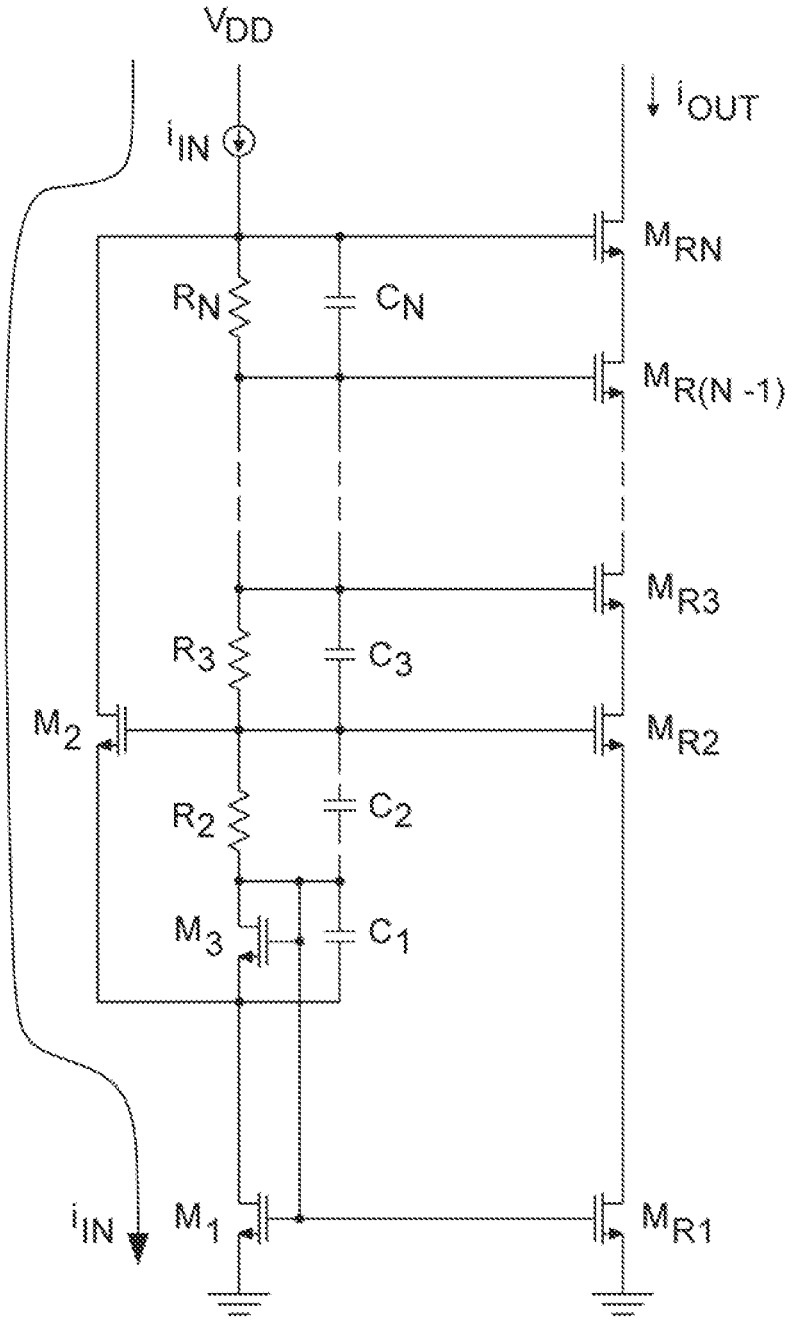
FIG. 12 shows an example of a self-biased multiple-cascode current mirror circuit that can include one or more high frequency bypass capacitors.

FIG. 12 shows an example of a self-biased multiple-cascode current amplifier, which can be regarded as a generalization of the circuit in FIG. 11 for an N≥2 number of output cascode devices. Capacitors $C_1$, $C_2$, . . . , $C_N$ (each can be as large as several pF) are optional and behave like short-circuits at high-frequencies. At high frequencies, without $C_2$ in the circuit, the small input impedance of the amplifier can be ensured by the equivalent diode-connected transistors $M_1$ and $M_2$; with $C_2$ in the circuit and shorting $M_2$ at high frequencies, the input impedance reduces to the equivalent resistance of diode-connected $M_1$ only. Current amplification can be achieved by scaling $M_{R1}$ (and implicitly $M_{R2}$, . . . , $M_{RN}$) relative to $M_1$ and $M_2$.

Figure 13:
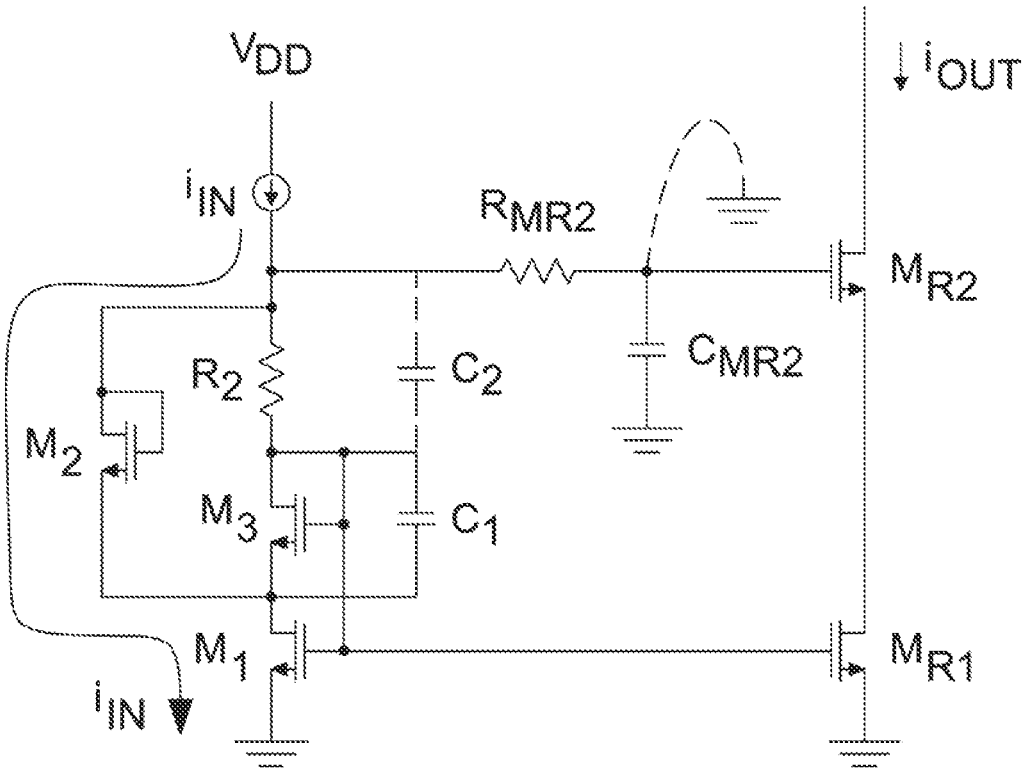
FIG. 13 shows an example of a self-biased current mirror circuit that can include a lowpass filter such as at a gate of a cascode device.

FIG. 13 shows another example, which can be regarded as a variant of the circuit shown in FIG. 11. In an example, an additional gate resistor $R_{MR2}$ (e.g., on the order of 10 KΩ or larger) and gate capacitor $C_{MR2}$ (e.g., as large as several pF) can be connected to the gate of $M_{R2}$, such as to provide a virtual short-circuit on the gate of $M_{R2}$ at high frequencies.

Figure 14:
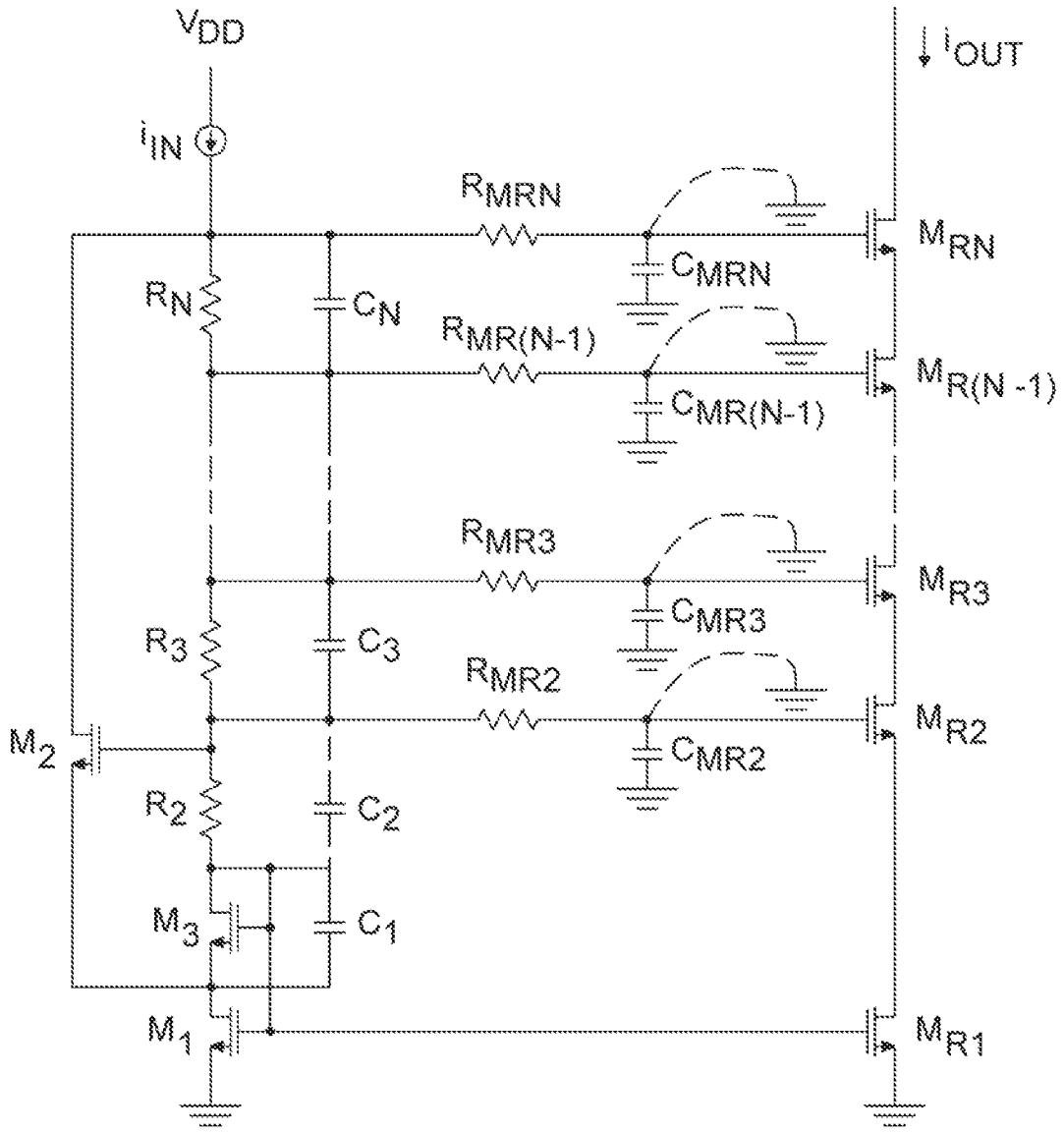
FIG. 14 shows a generalized example of a self-biased multiple cascode current mirror circuit that can include one or more lowpass filters such as at one or more gates of the cascode devices, or one or more high frequency bypass capacitors, or both.

FIG. 14 shows an example of a generalization for an N≥2 number of output cascode devices. In an example, additional resistors $R_{MR3}$, . . . , $R_{MRN}$ and additional capacitors $C_{MR3}$, . . . , $C_{MRN}$ can be connected to the gates of additional cascodes $M_{R3}$, . . . , $M_{RN}$, such as for providing short circuits to ground at high frequencies.

Figure 15:
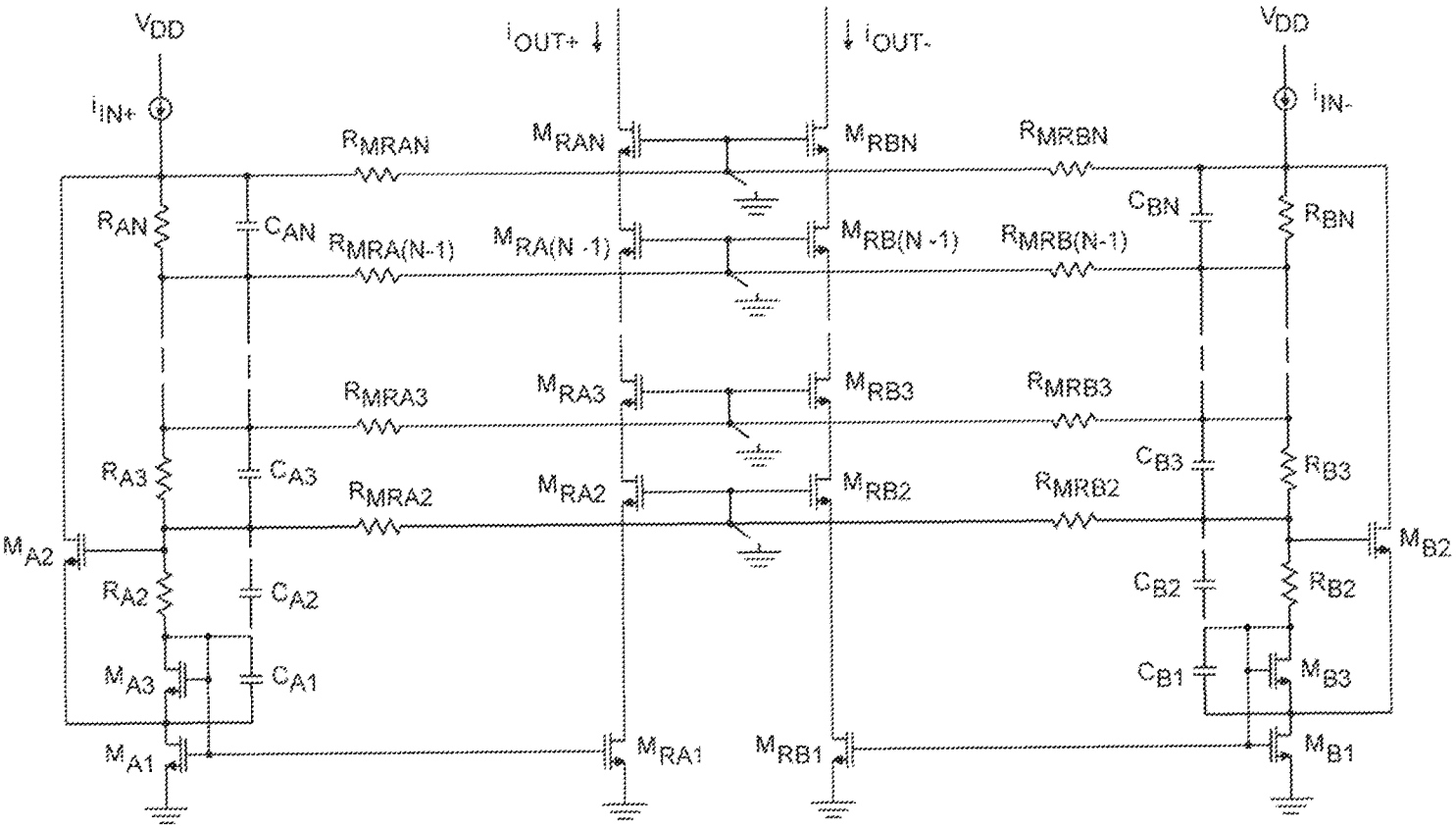
FIG. 15 shows a differential generalized example, which can be regarded similar to the circuit in FIG. 14.

FIG. 15 shows a differential example, which can be regarded similar to the circuit in FIG. 14. In the example of FIG. 15, the input current signals can be of the form $i_{IN+}(t)=I_{DC}+I_{IN}\cos(\omega_0 t+\Phi_0)$ and $i_{IN-}(t)=I_{DC}-I_{IN}\cos(\omega_0 t+\Phi_0)$, which, owing to circuit symmetry, can help ensure that the midpoints of the circuits are signal virtual grounds. In this way, no additional capacitors need be required on the gates of cascode transistors $M_{RA2}$, . . . , $M_{RAN}$ and $M_{RB2}$, . . . , $M_{RBN}$.

Figure 16:
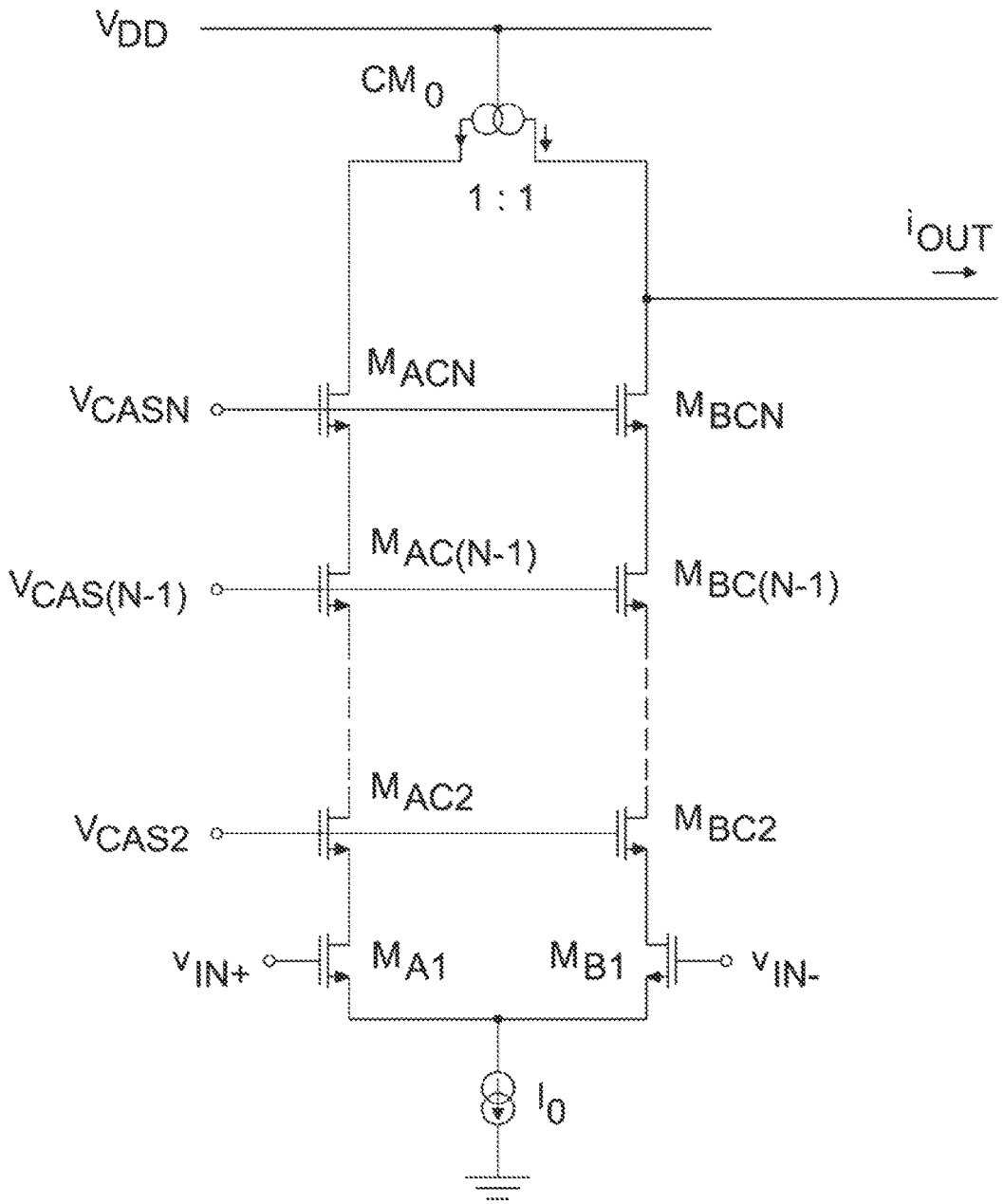
FIG. 16 shows an example of a single-ended-output operational transconductance amplifier (OTA), which can incorporate the self-biased current mirror/scaler, such as shown in the various examples herein.

FIG. 16 shows an example of a single-ended-output operational transconductance amplifier (OTA), which can incorporate the self-biased current mirror/scaler, such as shown in the various examples herein.

Figure 17:
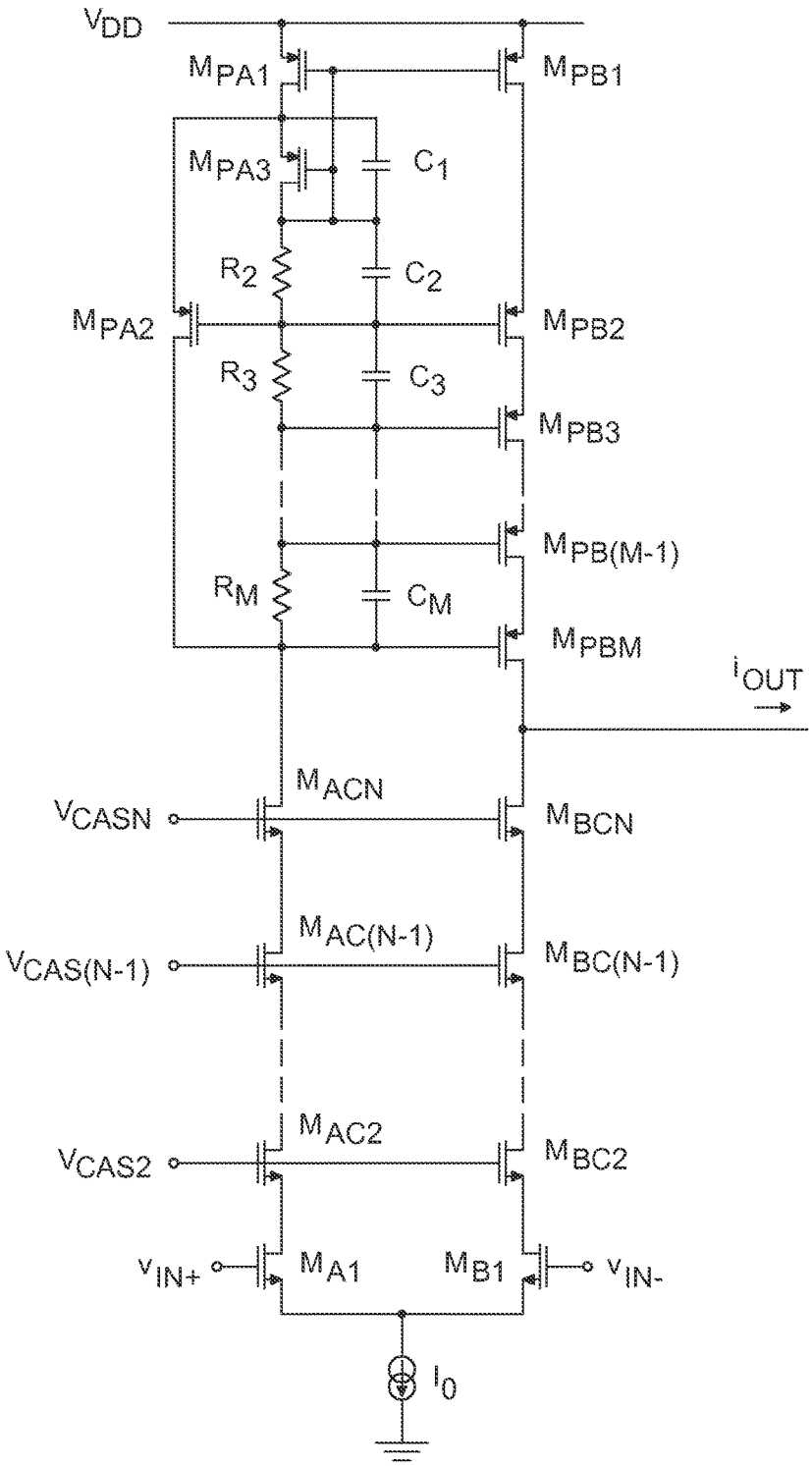
FIG. 17 shows an example of a self-biased multiple-cascode current mirror/scaler, e.g., similar to the one shown in FIG. 12, which can be employed to provide the current mirror $CM_0$ in FIG. 16.

FIG. 17 shows an example of a self-biased multiple-cascode current mirror/scaler, e.g., similar to the one shown in FIG. 12, can be employed to provide the current mirror $CM_0$ in FIG. 16.

Figure 18:
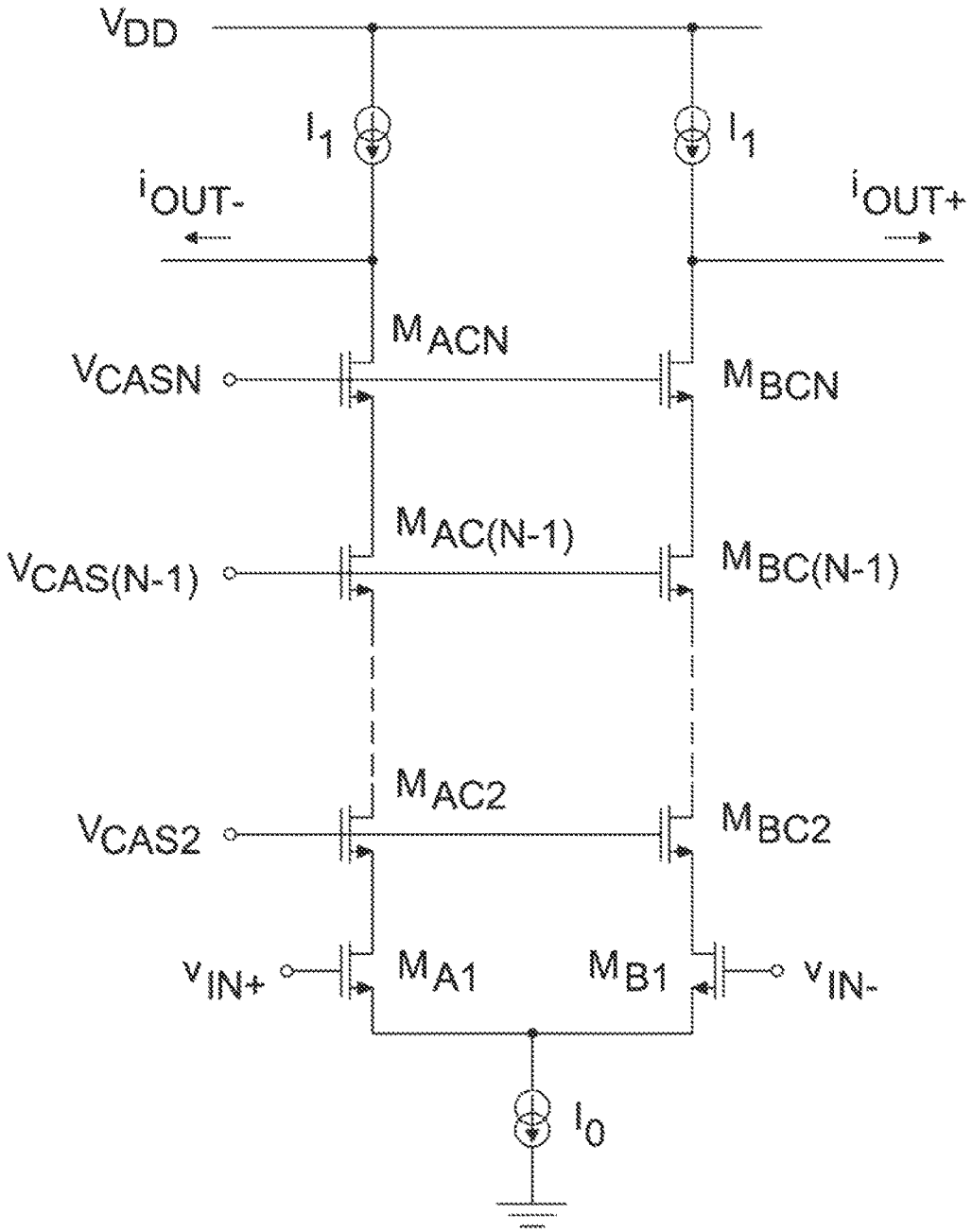
FIG. 18 shows an example of a differential-output operational transconductance amplifier.

FIG. 18 shows an example of a differential-output operational transconductance amplifier in which the common-mode circuit for adjusting either $I_0$ or $I_1$ is omitted for clarity.

Figure 19:
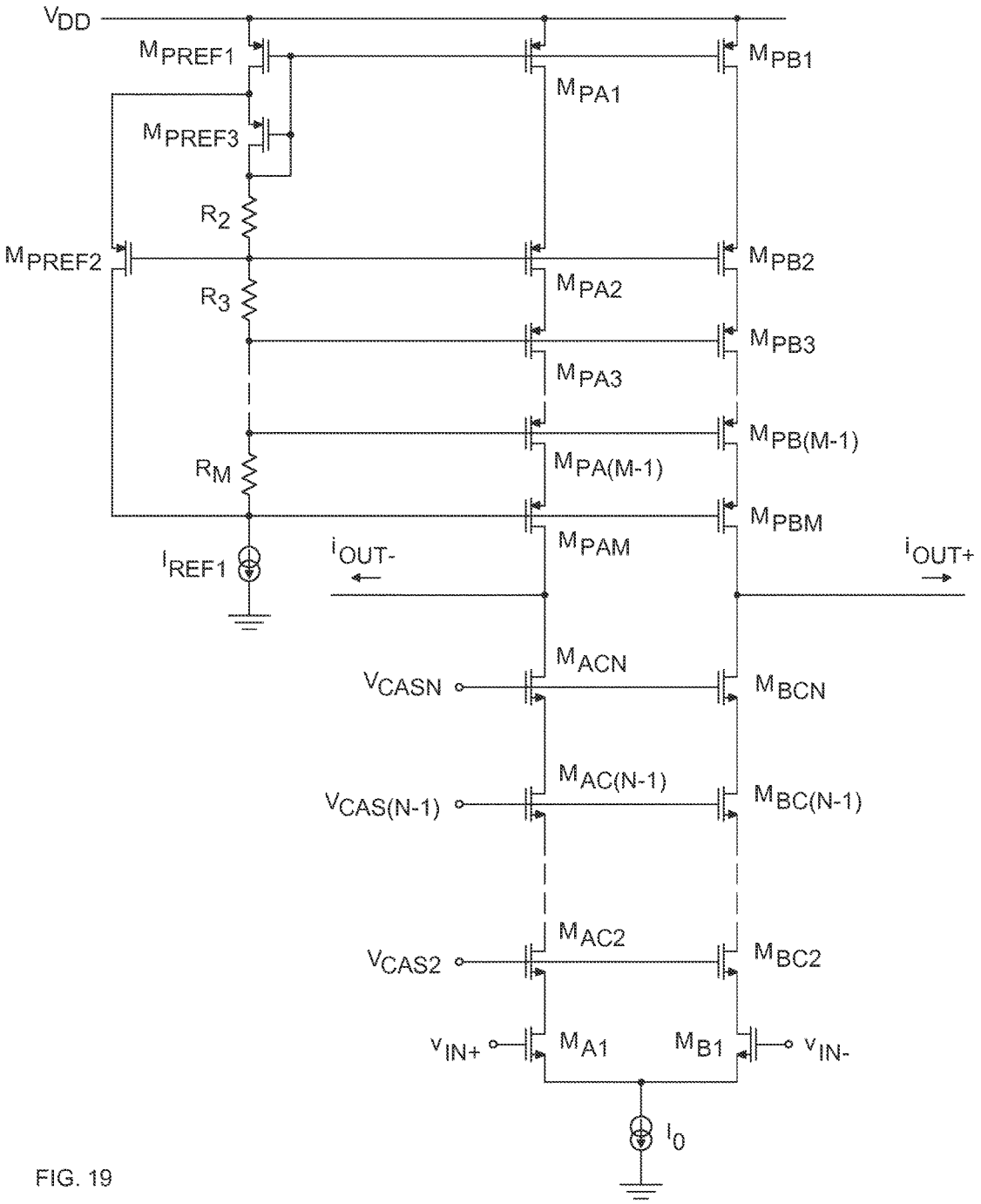
FIG. 19 shows an example in which a self-biased multiple-cascode current mirror/scaler, e.g., similar to that shown in FIG. 8, can be employed as to provide the current source $I_1$ in FIG. 18.

FIG. 19 shows an example in which a self-biased multiple-cascode current mirror/scaler, e.g., similar to that shown in FIG. 8, can be employed as to provide the current source $I_1$ in FIG. 18.

Figure 20:
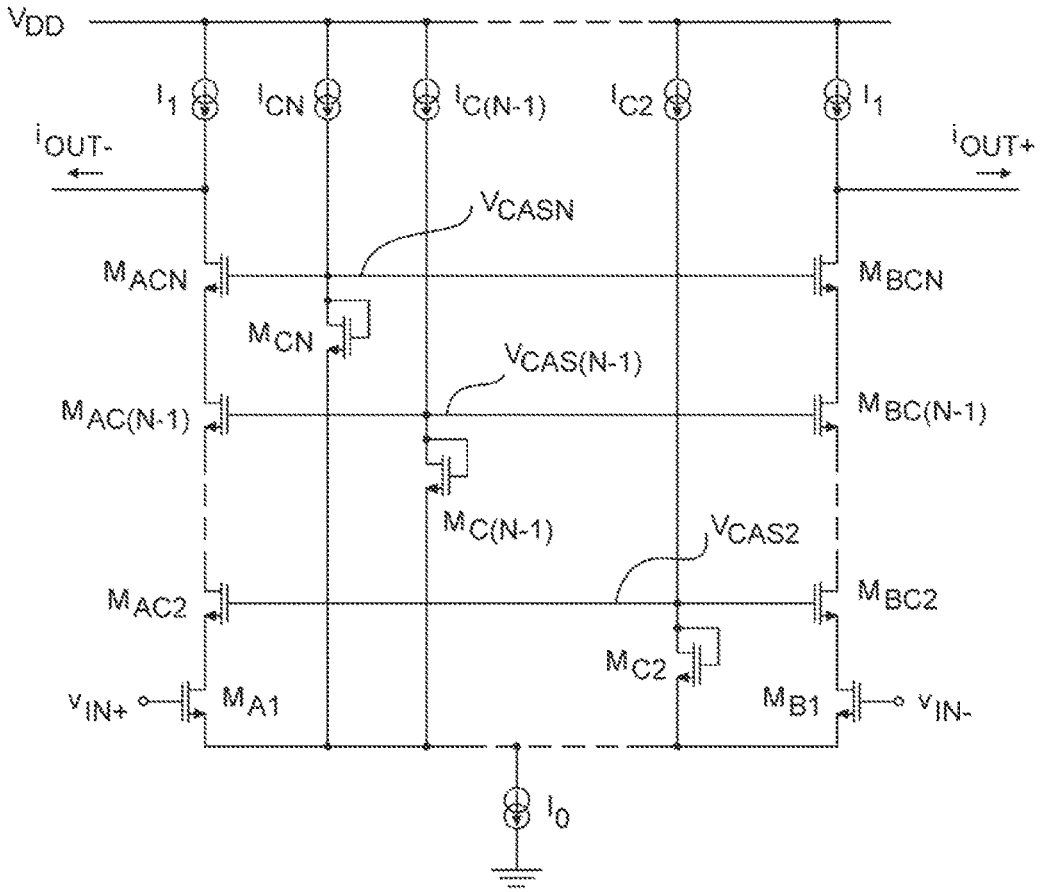
FIG. 20 shows an approach for providing a generalized cascode circuit for generating cascode voltages $V_{CAS2}, \ldots, V_{CASN}$ in FIG. 18.

FIG. 20 shows an approach for providing a generalized cascode circuit for generating cascode voltages $V_{CAS2}$, . . . , $V_{CASN}$ in FIG. 18. The approach shown in FIG. 20 can use multiple cascode bias currents $I_{C2}$, . . . , $I_{CN}$, as well as a multiplicity of devices with unwieldy geometries $M_{C2}$, . . . , $M_{CN}$. The current through the main amplifying devices $M_{A1}$ and $M_{B1}$ is obtained as the difference between $I_0(=2I_1)$ and $(I_{C2}+\ldots+I_{CN})$, which can be difficult to control.

Figure 21:
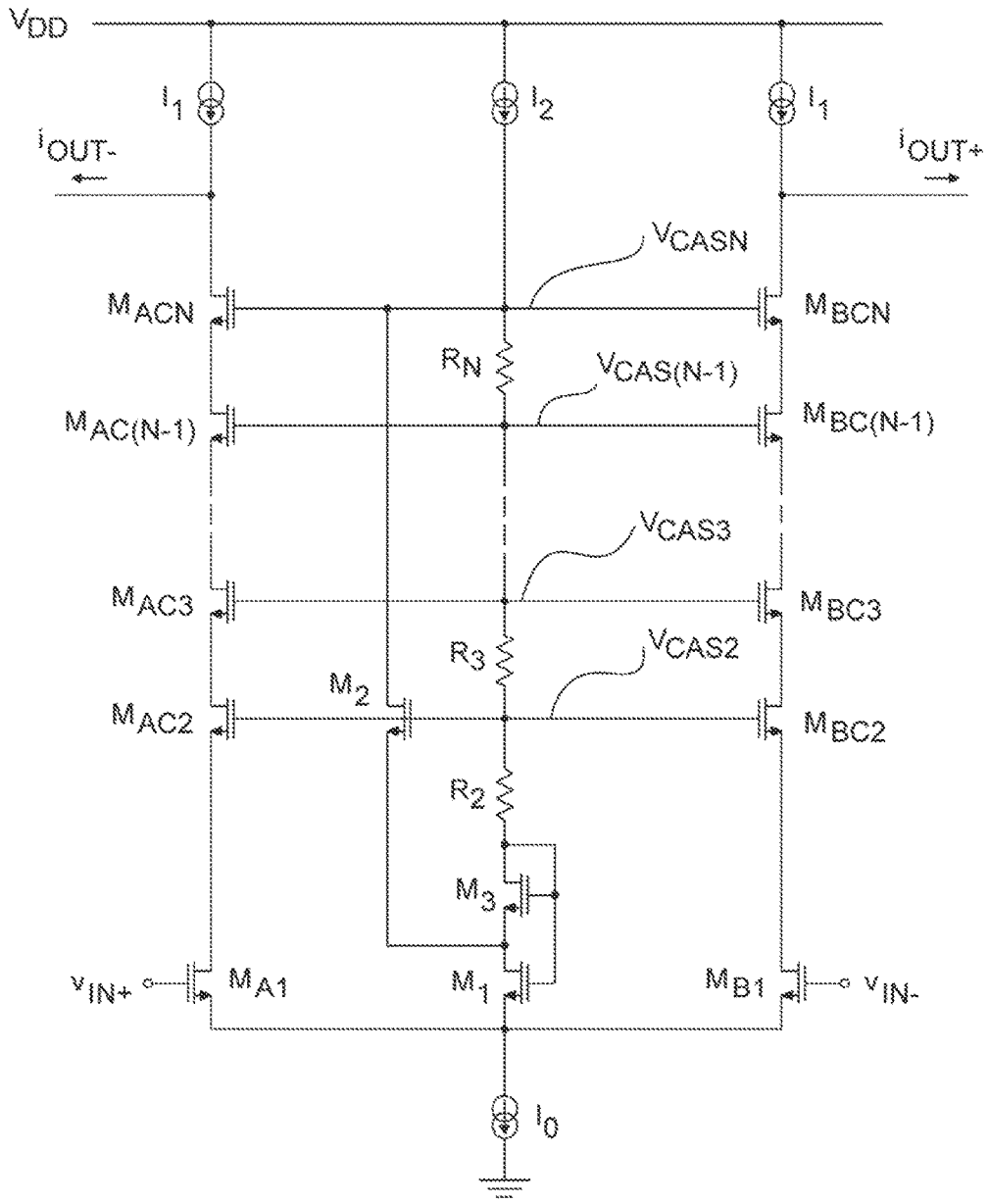
FIG. 21 shows an example of an improved approach (relative to that shown in FIG. 20) for generating cascode voltages $V_{CAS2}, \ldots, V_{CASN}$ in FIG. 18, such as by using a self-biasing branch similar to the one used in the circuit of FIG. 6.

FIG. 21 shows an example of an improved approach for generating cascode voltages $V_{CAS2}$, . . . , $V_{CASN}$ in FIG. 18, such as by using a self-biasing branch similar to the one used in the circuit of FIG. 6. In an example, only one bias current is used for the cascode bias branch, all transistors have similar geometries, and the current through the main amplifying devices $M_{A1}$ and $M_{B1}$ is better controlled, being the difference between $I_0(=2I_1)$ and just one current, $I_2$.

Figure 22:
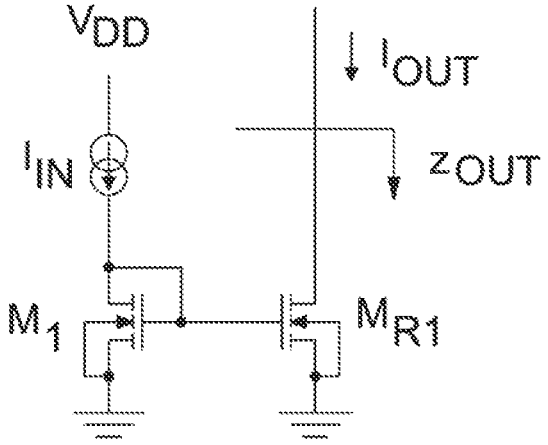
FIG. 22 shows an approach to a CMOS current mirror used for comparison in the computer-simulated plots of FIGS. 23-30.

FIG. 22 shows an approach to a CMOS current mirror used for comparison in the plots of FIGS. 23-30.

Figure 23:
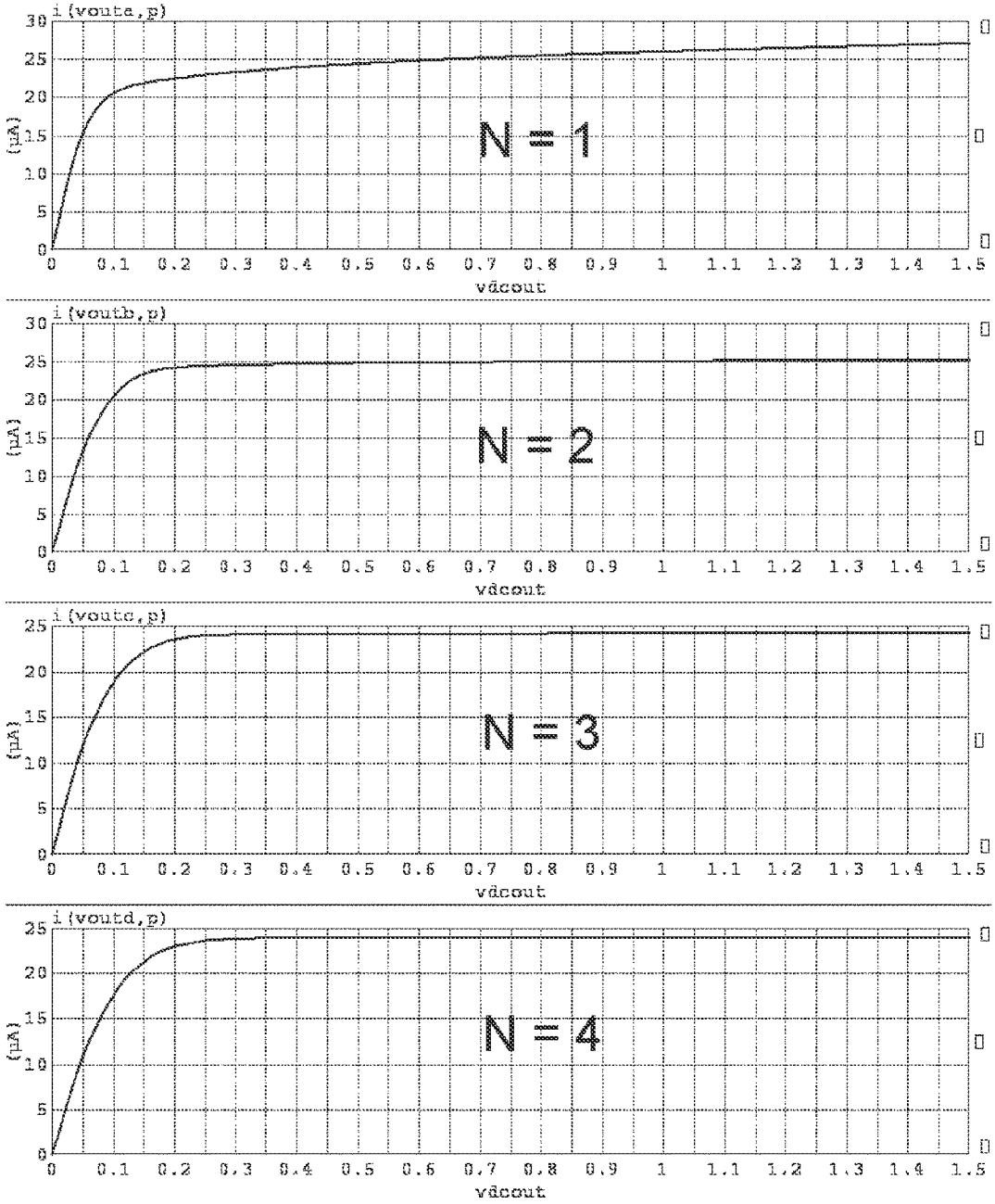
FIGS. 23-25 show examples of the computer-simulated output current-voltage characteristics of the self-biased multiple-cascode current mirror circuit of FIG. 7.
Figure 24:
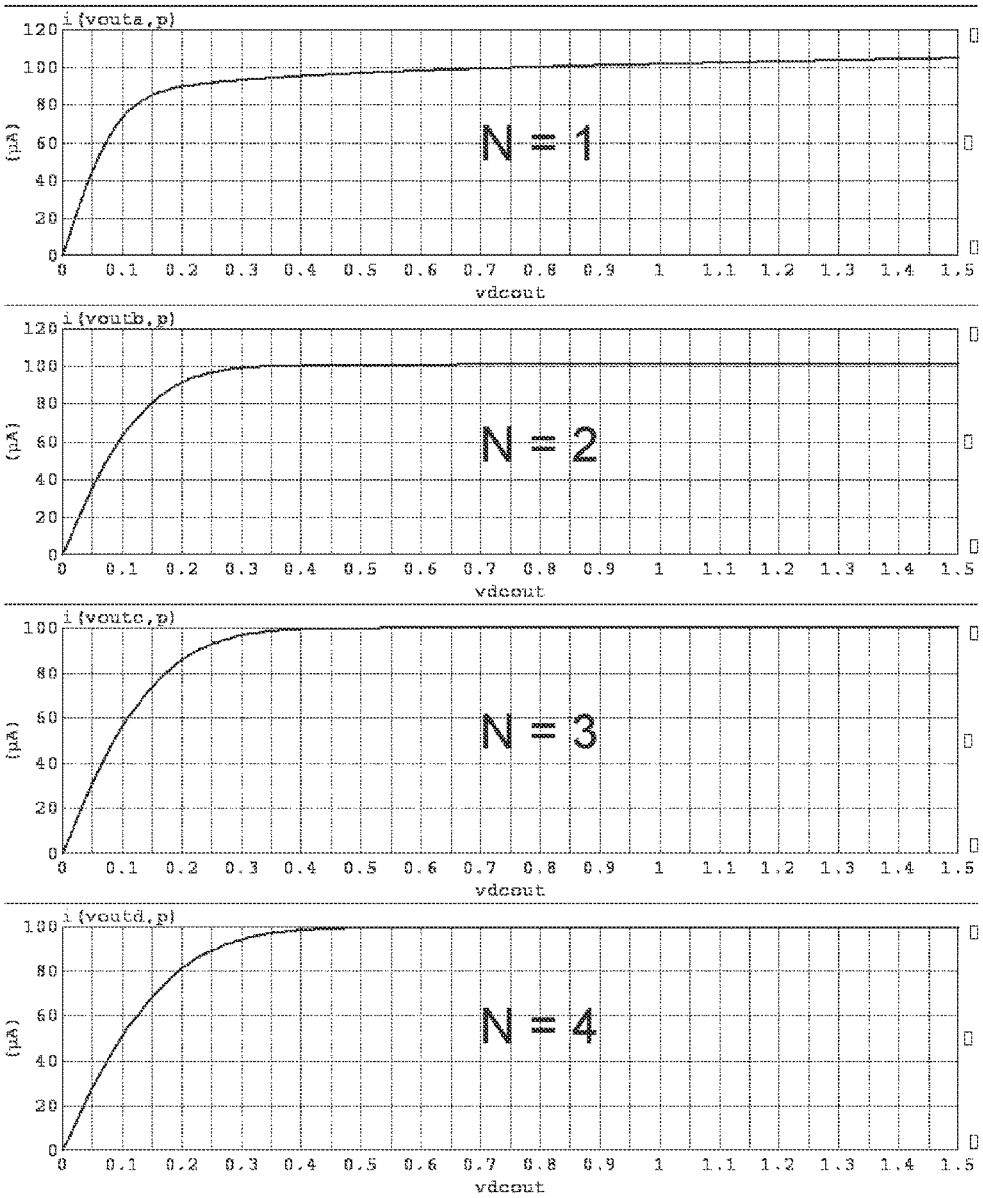
Figure 25:
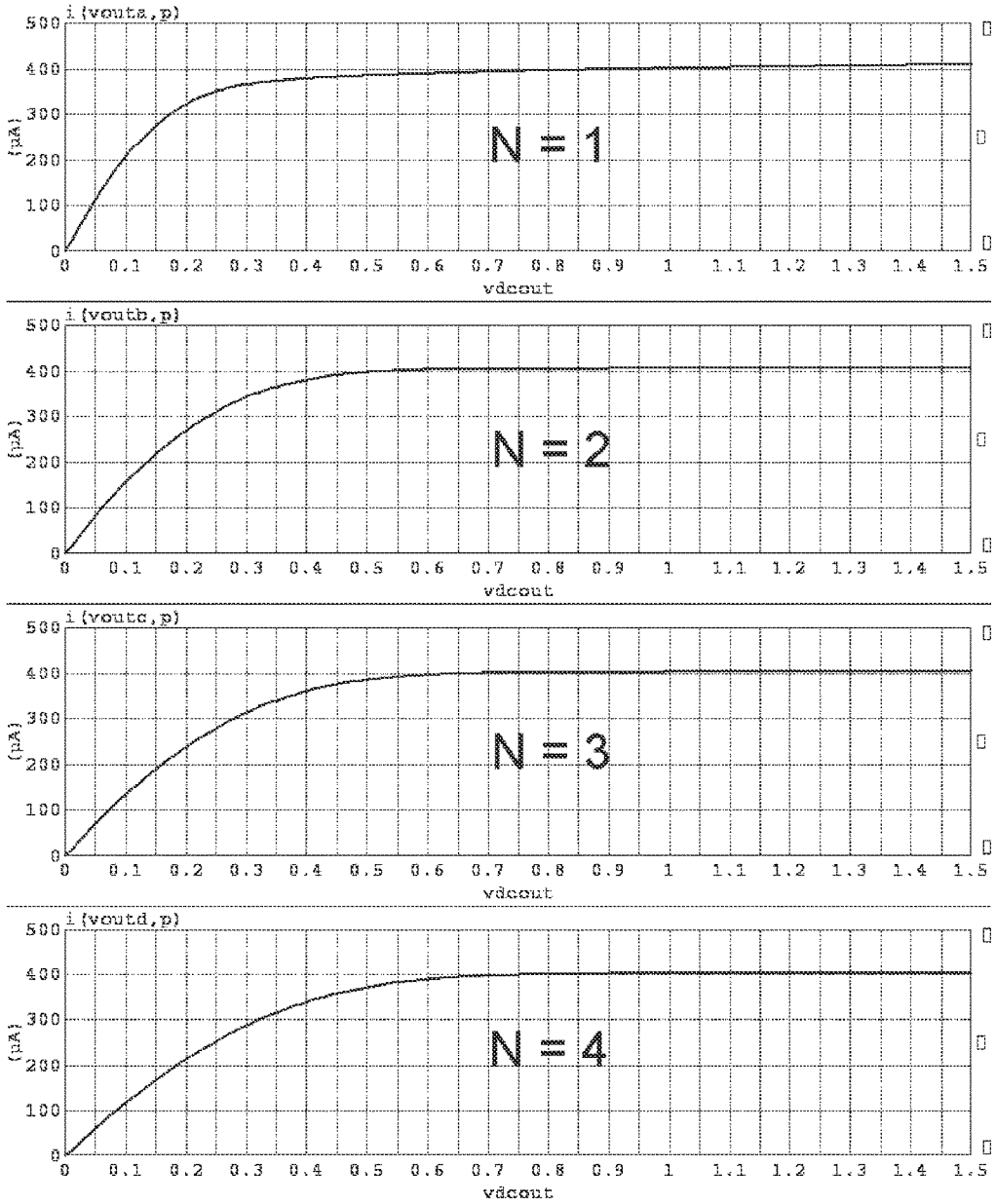

FIGS. 23-25 show examples of the computer-simulated output current-voltage characteristics of the self-biased multiple-cascode current mirror circuit of FIG. 7, such as for different values of N (N=1 corresponds to the current mirror circuit of FIG. 22) and input currents (25 μA, 100 μA, and 400 μA, respectively). In these examples, all transistors are high-voltage devices in a 65 nm CMOS process, with W=20 μm, L=0.5 μm; $M_2$ is slightly undersized for additional cascode headroom, having W=15 μm, L=0.5 μm. Resistors $R_2$, . . . , $R_N$ are 15 KΩ each. All cascoded current mirrors operate very well with minimal voltage headroom for the cascode devices, over a wide range of input currents.

Figure 26:
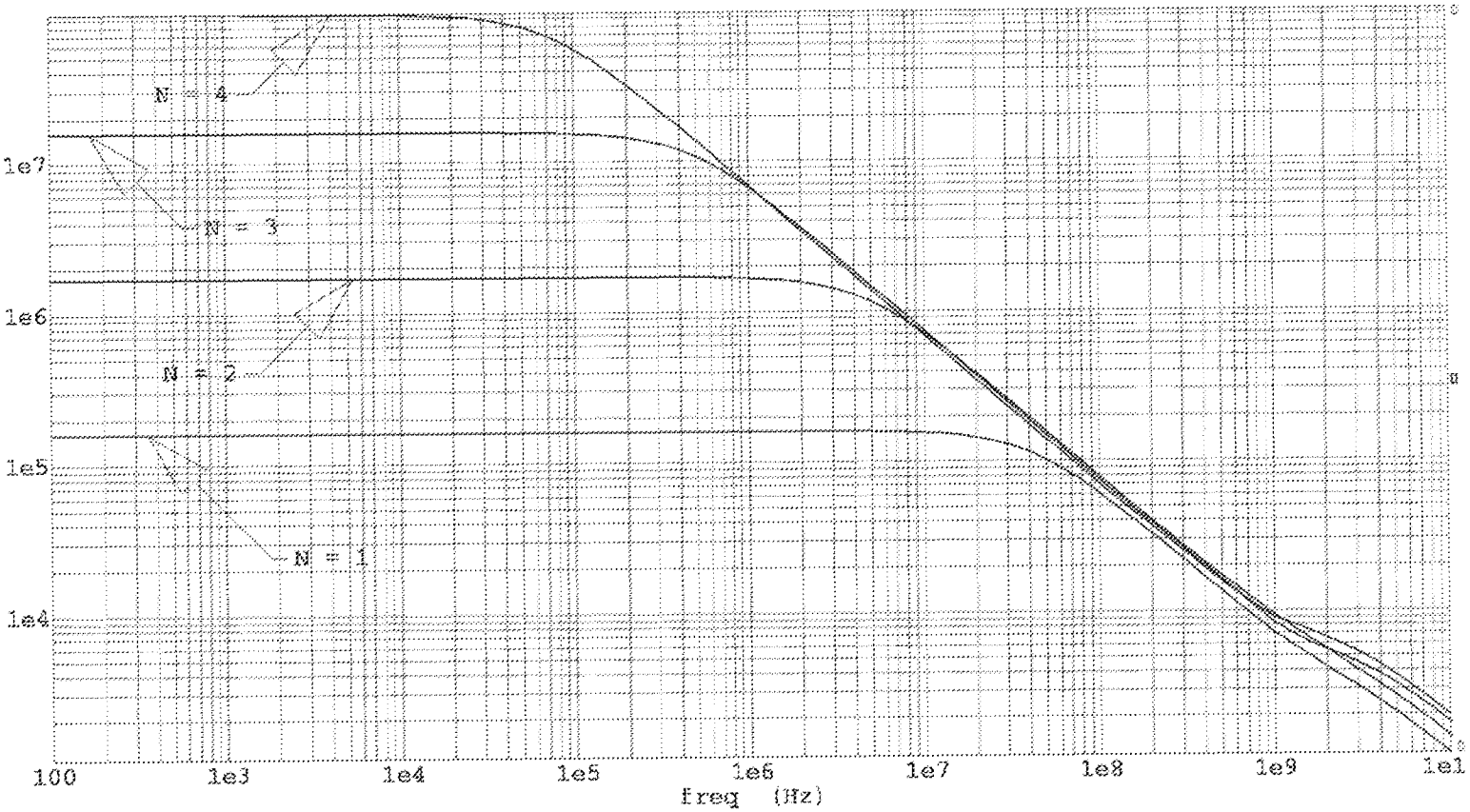
FIG. 26 shows computer-simulated example of the output impedance $z_{OUT}$ of four circuit variants.

FIG. 26 shows computer-simulated example of the output impedance $z_{OUT}$ of the four circuit variants under consideration; a substantial improvement in $z_{OUT}$ can be achieved as N is increased. All computer-simulated circuits exhibit robustness over temperature and process.

Figure 27:
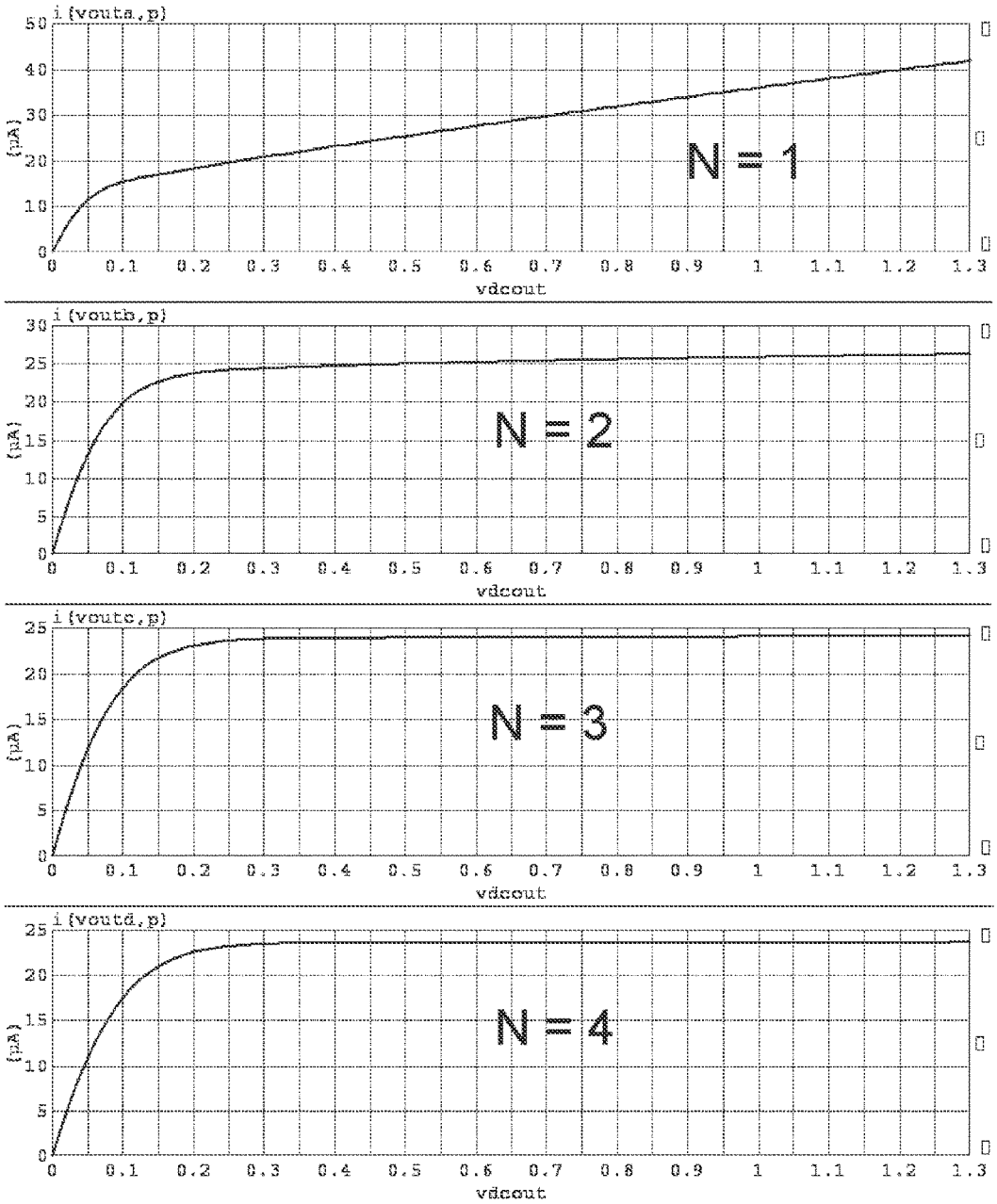
FIGS. 27-29 show the computer-simulated examples of output current-voltage characteristics of the self-biased multiple-cascode current mirror circuit of FIG. 7, such as for different values of N
Figure 28:
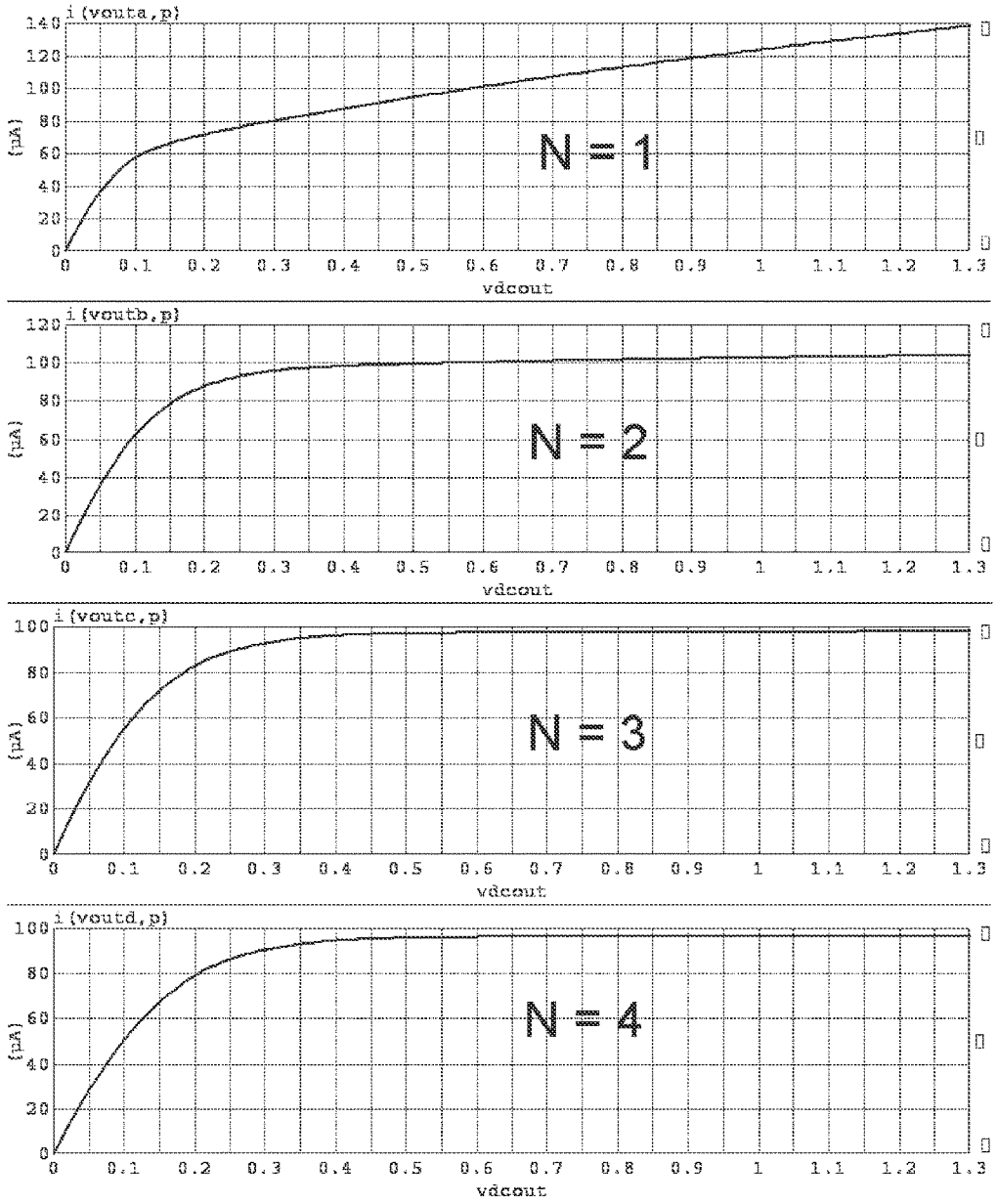
Figure 29:
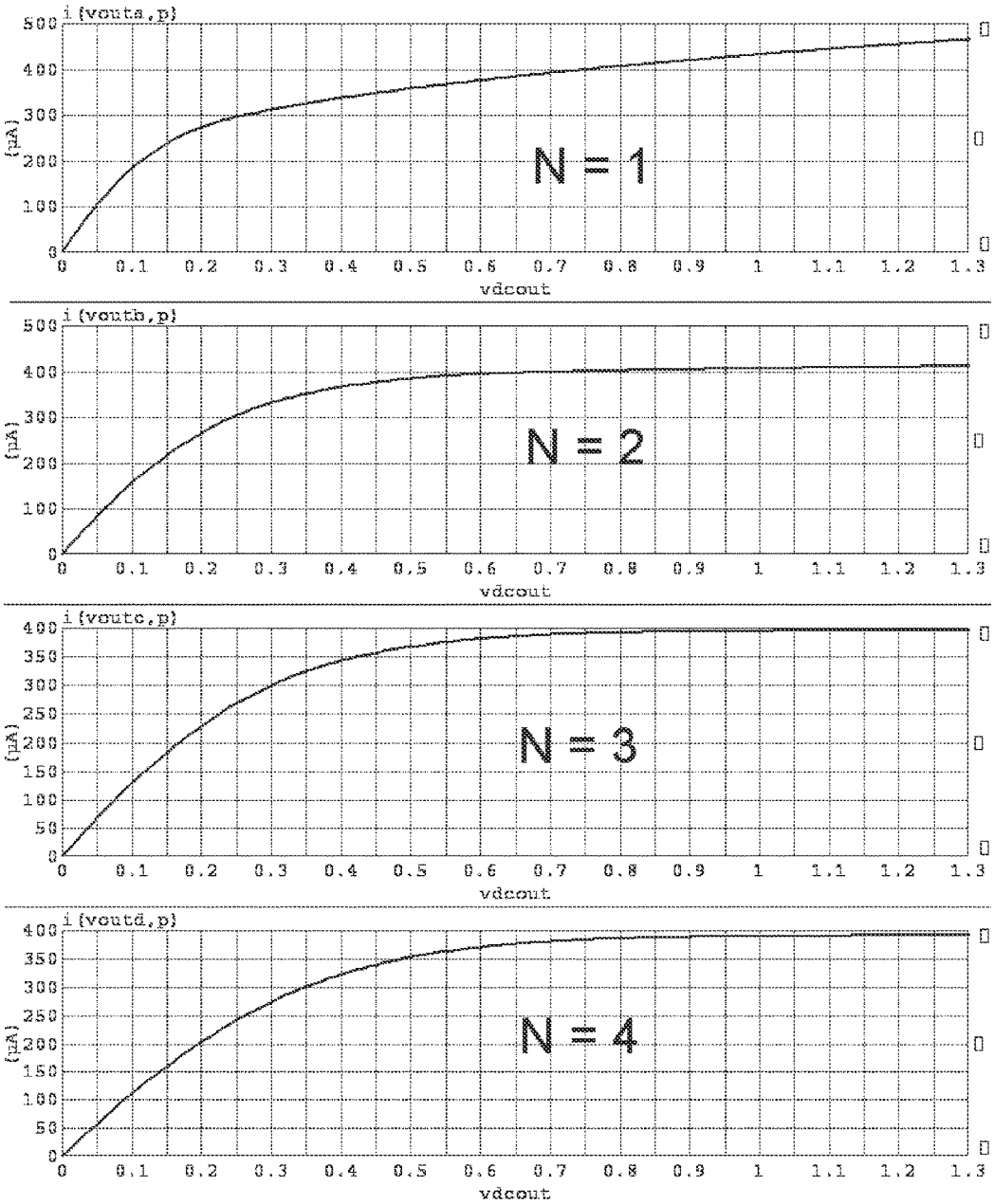

FIGS. 27-29 show the computer-simulated output current-voltage characteristics of the self-biased multiple-cascode current mirror circuit of FIG. 7, such as for different values of N (N=1 corresponds to the current mirror circuit of FIG. 22) and input currents (25 μA, 100 μA, and 400 μA, respectively). All transistors are low-voltage devices in a 65 nm CMOS process, with W=4 μm, L=0.1 μm; $M_2$ is slightly undersized for additional cascode headroom, having W=3.2 μm, L=0.1 μm. Resistors $R_2$, . . . , $R_N$ are 50 KΩ each. All computer-simulated cascoded mirrors operate very well with minimal headroom required for the cascode devices, over a wide range of input currents.

Figure 30:
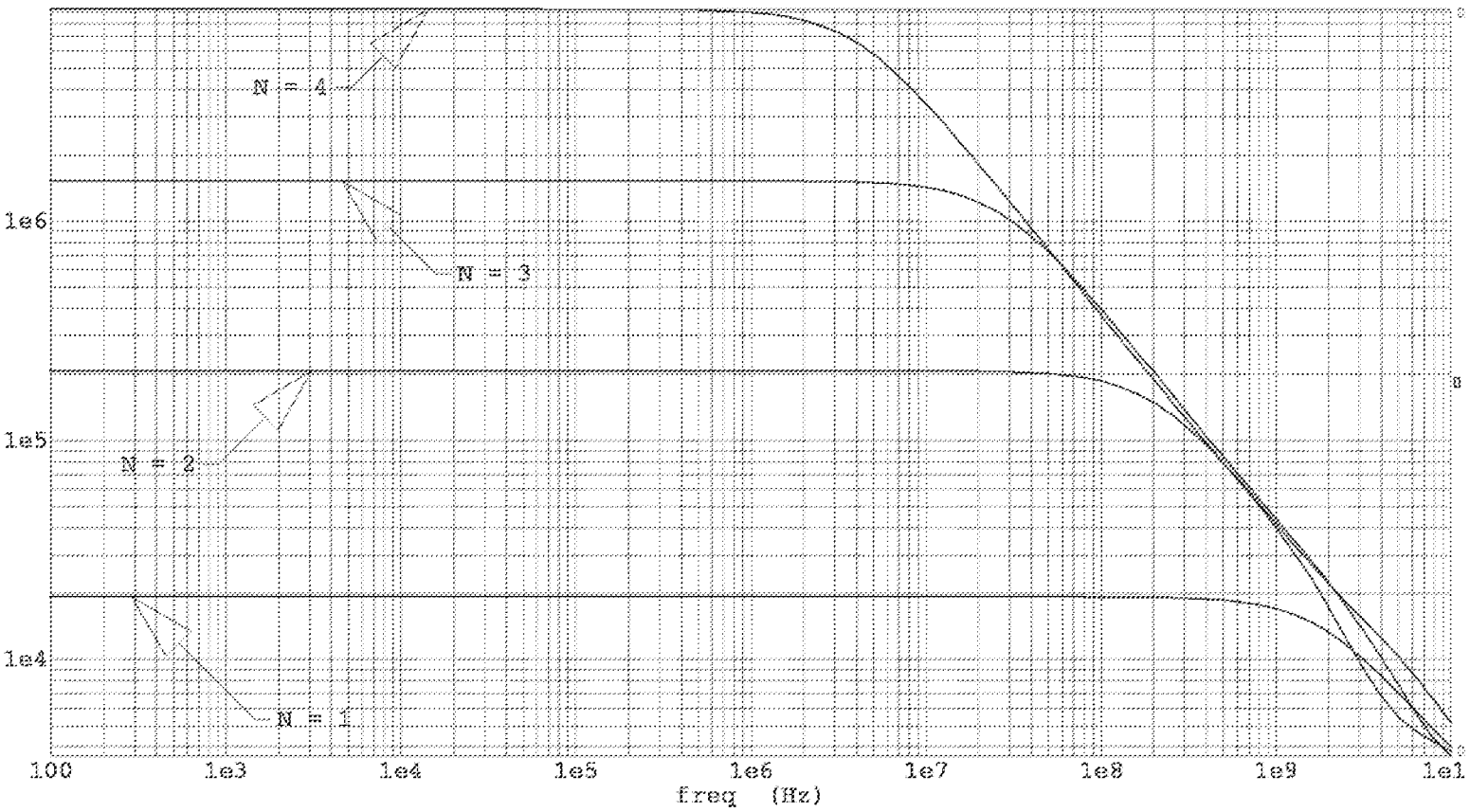
FIG. 30 shows an example of the computer-simulated output impedance $z_{OUT}$ of four circuit variants.

FIG. 30 shows an example of the computer-simulated output impedance $z_{OUT}$ of the four circuit variants under consideration; a substantial improvement in $z_{OUT}$ can be achieved as N is increased. All computer-simulated circuits exhibit robustness over temperature and process.

The present description has described biasing and operation in terms of a FET drain-source saturation voltage, $V_{DSAT}$ or ΔVds in saturation. To provide a wider range of output voltages that can be tolerated by the current mirror/scaler, it may be desirable to provide such biasing with the FET drain-source saturation voltage, $V_{DSAT}$ or ΔVds at the edge of saturation (EOS), however, this is not required, even though it is desirable.

Moreover, although certain devices have been described as "replicas," it is understood that scaled replica devices can be provided, and that such scaling can be accomplished in a number of ways, such as by scaling the W/L ratios of the FETs, or by using a desired number of like parallel input FETs and a desired number of like parallel output FETs of the current mirror/scaler to obtain a desired current scaling.

Further, although the cascode FETs have been described together with the output FETs as "replicas" it is understood that this is not required. For example, a longer channel length output FET can be used together with one or more shorter channel cascode FETs in series therewith, which will increase the output impedance of the circuit, but can allow increased voltage swing by establishing a different ΔVds in saturation for the one or more cascode FETs than for the output FET, if desired.

The foregoing description and drawings of embodiments are merely illustrative of the principles of the invention. Various modifications can be made to the embodiments by those skilled in the art without departing from the scope of the invention, which is defined in the appended claims.

The claimed invention is:

1. A low voltage cascode current mirror device comprising:

a current mirror input FET;

a current mirror first output FET;

a first cascode FET in series with the current mirror first output FET; and a bias circuit, arranged to bias gate terminals of the current mirror input and first output FETs at a FET drain-source saturation voltage ΔVds of the current mirror input summed with a FET threshold voltage generated by the bias circuit, and to bias a gate terminal of the first cascode FET at the FET drain-source saturation voltage ΔVds of the current mirror input FET summed with both a FET threshold voltage generated by the bias circuit and with a FET drain-source saturation voltage ΔVds generated by the bias circuit.

2. The device of claim 1, wherein the cascode current mirror device is included in an operational transcoductance amplifier (OTA).

3. The device of claim 1, wherein each of the FET drain-source saturation voltages (ΔVds) is specified as an edge of saturation voltage ΔVds,eos.

4. The device of claim 1, wherein a gate of the input FET is directly electrically connected to the gate of the first output FET.

5. The device of claim 1, wherein the input FET is a first input FET and further comprising a second input FET, wherein a gate of the first output FET is connected to a gate of the second input FET that is arranged in a current mirror configuration with the first output FET, and wherein the second input FET is biased using a second input current that is provided in addition to the first input current.

6. The device of claim 1, wherein the first bias circuit comprises:

a bias field-effect transistor (FET), having a drain electrically coupled to a gate, and having a source. the bias FET biased using a first input current to generate a gate-source bias voltage. Vgs, between the gate and the source of the bias FET; and an active or passive voltage divider circuit to divide Vgs of the bias FET into a first voltage component of the voltage divider circuit specified at a FET threshold voltage of the bias FET and a second voltage component of the voltage divider circuit specified at a FET drain-source saturation voltage AVds of the same bias FET;

wherein the current mirror input FET is arranged to receive a drain current from the bias FET and from the active or passive voltage divider circuit;

wherein the current mirror first output FET includes a gate electrically coupled to apply a voltage equal to the voltage at the gate of the current mirror input FET, a drain of the current mirror first output FET providing a first output current that is mirrored or scaled as a specified function of the first input current; and wherein the first cascode FET includes a gate that is biased by the first bias circuit at a voltage that is equal to the second voltage component in sum with the first voltage component in sum with a FET drain-source saturation voltage ΔVds of the input FET.

7. The device of claim 2, wherein the OTA is a differential OTA.

8. The device of claim 6, wherein the first bias circuit is arranged to provide one or more additional FET drain-source saturation voltages ΔVds in series and summed with the second voltage component in sum with the first voltage component in sum with a FET drain-source saturation voltage ΔVds; and the first output stage comprises one or more additional cascode FETs in series with the first output FET to pass the first output current between a drain and a source of each of the cascode FETs, gates of the one or more additional cascode FETs respectively coupled to the first bias circuit to receive a corresponding number of one or more additional FET drain-source saturation voltages ΔVds in series and summed with the second voltage component in sum with the first voltage component in sum with a FET drain-source saturation voltage ΔVds.

9. The device of claim 6, wherein the first bias circuit includes a diode-connected FET across which the first voltage component is provided.

10. The device of claim 6, including a first capacitor coupled to AC bypass the first voltage component of the first bias circuit.

11. The device of claim 6, comprising:

a first capacitor arranged to AC couple a gate of the first cascode FET to an AC ground; and a first resistor, electrically coupled to the first capacitor to create a lowpass filter for a gate voltage of the first cascode FET.

12. The device of claim 6, comprising first and second ones of the self-biased cascode current mirror/scaler circuits, arranged in a differential configuration, wherein:

gates of the respective first cascode FETs of the first and second self-biased cascode current mirror/scaler circuits are electrically coupled by active or passive resistors to a common AC ground; and drains of the respective first output FETs of the first and second self-biased cascode current mirror/scaler circuits provide respective first output currents in a differential relationship to each other.

13. The device of claim 6, wherein the current mirror input FET is in series with at least one of the bias FET and the first bias circuit.

14. The device of claim 8, comprising:

a first capacitor coupled to AC bypass the first voltage component of the bias circuit;

a second capacitor coupled to AC bypass the second voltage component of the bias circuit; and one or more additional capacitors coupled to AC bypass the one or more additional FET drain-source saturation voltages ΔVds.

15. The device of claim 8, comprising:

a first capacitor arranged to AC couple a gate of the first cascode device to an AC ground; and a first resistor, electrically coupled to the first capacitor to create a lowpass filter for a gate voltage of the first cascode FET.

16. The device of claim 8, comprising one or more additional output stages, arranged in parallel with the first output stage, to provide a corresponding one or more additional output currents, the one or more additional output stages respectively including:

an additional output FET, having a gate coupled to apply, at the gate of the additional output FET, a voltage at the gate of the current mirror input FET, a drain of the additional output FET providing an additional output current that is mirrored or scaled as a specified function of the first input current; and an additional cascode FET, in series with the additional output FET to pass an additional output current between a drain and a source of the additional cascode FET, a gate of the additional cascode FET biased by the first bias circuit at a voltage that is the second voltage component in sum with the first voltage component in sum with a FET drain-source saturation voltage ΔVds.

17. The device of claim 10, including a second capacitor coupled to AC bypass the second voltage component of the bias circuit.

18. The device of claim 13, wherein the first bias current is provided to a parallel combination of the bias FET and the first bias circuit.

19. The device of claim 15, comprising:

one or more additional capacitors arranged to respectively AC couple corresponding gates of the one or more additional capacitors to AC ground; and one or more additional resistors, respectively electrically coupled to the one or more additional capacitors to create respective lowpass filters for gate voltages of the one or more additional cascode FETs.

20. The device of claim 16, wherein:

the first bias circuit is arranged to provide one or more additional FET drain-source saturation voltages ΔVds in series and summed with the second voltage component in sum with the first voltage component in sum with a FET drain-source saturation voltage ΔVds; and the additional output stage comprises one or more additional cascode FETs in series with the additional output FET to pass the additional output current between a drain and a source of each of the additional cascode FETs, gates of the one or more additional cascode FETs respectively coupled to the first bias circuit to receive a corresponding number of one or more additional FET drain-source saturation voltages ΔVds in series and summed with the second voltage component in sum with the first voltage component in sum with a FET drain-source saturation voltage ΔVds.

21. A device comprising:

a self-biased cascode current mirror/scaler circuit, comprising:

a bias field-effect transistor (FET), having a drain electrically coupled to a gate, and having a source, the bias FET biased using a first input current to generate a gate-source bias voltage, Vgs, between the gate and the source of the bias FET;

a first bias circuit, electrically coupled to the bias FET to receive Vgs, the first bias circuit arranged include an active or passive voltage divider circuit to divide Vgs into a first voltage component of the voltage divider circuit specified at a FET threshold voltage of the bias FET and a second voltage component of the voltage divider circuit specified at a FET drain-source saturation voltage ΔVds of that same bias FET.

22. The device of claim 21, comprising: an input FET, the input FET having a drain electrically coupled to receive a drain current specified as a function of the first input current, the input FET in series with the first bias circuit, wherein the first bias circuit is arranged to apply, at a gate of the input FET, the first voltage component in sum with a FET drain-source saturation voltage AVds of the input FET.

23. The device of claim 22, further comprising:

a first output stage, comprising:

a first output FET, having a gate electrically coupled to apply a voltage equal to the voltage at the gate of the input FET, a drain of the output FET providing a first output current that is mirrored or scaled as a specified function of the first input current; and a first cascode FET, in series with the first output FET to pass the first output current between a drain and a source of the first cascode FET, a gate of the first cascode FET biased by the first bias circuit at a voltage that is the second voltage component in sum with a voltage at the gate of the first output FET; and wherein the first bias circuit is arranged to provide one or more additional FET drain-source saturation voltages ΔVds in series and summed with the second voltage component in sum with a voltage at the gate of the first output FET; and the first output stage comprises one or more additional cascode FETs in series with the first output FET to pass the first output current between a drain and a source of each of the cascode FETs, gates of the one or more additional cascode FETs respectively coupled to the first bias circuit to receive a corresponding number of one or more additional FET drain-source saturation voltages ΔVds in series and summed with the second voltage component in sum with the voltage at the gate of the first output FET.

24. The device of claim 22, further comprising:

a first capacitor coupled to AC bypass the first voltage component of the bias circuit;

a second capacitor coupled to AC bypass the second voltage component of the bias circuit;

one or more additional capacitors coupled to AC bypass the one or more additional FET drain-source saturation voltages ΔVds;

a first capacitor arranged to AC couple a gate of the first cascode device to an AC ground;

a first resistor, electrically coupled to the first capacitor to create a lowpass filter for a gate voltage of the first cascode FET;

one or more additional capacitors arranged to respectively AC couple corresponding gates of the one or more additional capacitors to AC ground; and one or more additional resistors, respectively electrically coupled to the one or more additional capacitors to create respective lowpass filters for gate voltages of the one or more additional cascode FETs.

25. The device of claim 23, further comprising:

one or more additional output stages, arranged in parallel with the first output stage, to provide a corresponding one or more additional output currents, the one or more additional output stages respectively including:

an additional output FET, having a gate coupled to apply, at the gate of the additional output FET, a voltage equal to the voltage at the gate of the input FET, a drain of the additional output FET providing an additional output current that is mirrored or scaled as a specified function of the first input current; and an additional cascode FET, in series with the additional output FET to pass an additional output current between a drain and a source of the additional cascode FET, a gate of the additional cascode FET biased by the first bias circuit at a voltage that is the second voltage component in sum with a voltage at the gate of the additional output FET.

26. A method comprising:

using a first input current to generate a bias FET gate-source bias voltage, Vgs;

dividing Vgs of the bias FET into a first voltage component specified at a FET threshold voltage of that same bias FET and a second voltage component specified at a FET drain-source saturation voltage ΔVds of that same bias FET;

applying at a gate of an input FET of a current mirror/scaler circuit the first voltage component in sum with a FET drain-source saturation voltage ΔVds of the input FET;

applying at a gate of an output FET of the current mirror/scaler circuit a voltage equal to the voltage at the gate of the input FET; and applying at a gate of a cascode FET of the current mirror/scaler circuit a voltage that is the second voltage component in sum with a voltage at the gate of the first output FET.

* * * * *